US008317269B2

(12) United States Patent
Smith

(10) Patent No.: US 8,317,269 B2
(45) Date of Patent: Nov. 27, 2012

(54) MESH STACKING CHAIR

(75) Inventor: Richard D. Smith, Spanish Fork, UT (US)

(73) Assignee: Mity-Lite, Inc., Orem, UT (US)

( * ) Notice: Subject to any disclaimer, the term of this patent is extended or adjusted under 35 U.S.C. 154(b) by 358 days.

(21) Appl. No.: 12/612,252

(22) Filed: Nov. 4, 2009

(65) Prior Publication Data

US 2010/0156155 A1 Jun. 24, 2010

Related U.S. Application Data

(63) Continuation-in-part of application No. 12/422,792, filed on Apr. 13, 2009, now Pat. No. 8,033,598, and a continuation-in-part of application No. 12/422,801, filed on Apr. 13, 2009, now Pat. No. 8,033,612, and a continuation-in-part of application No. 12/422,811, filed on Apr. 13, 2009, now Pat. No. 8,029,059, and a continuation-in-part of application No. 12/422,821, filed on Apr. 13, 2009, now Pat. No. 8,038,221.

(60) Provisional application No. 61/168,837, filed on Apr. 13, 2009, provisional application No. 61/140,756, filed on Dec. 24, 2008.

(51) Int. Cl.
*A47C 7/00* (2006.01)

(52) U.S. Cl. ..... 297/440.11; 297/447.1; 297/239

(58) Field of Classification Search ..... 297/56, 297/239, 440.11, 440.2, 440.21, 452.21, 297/452.23, 452.33, 452.36, 447.1, 447.2; 403/385, 394, 396, 400; 248/230.1, 230.5
See application file for complete search history.

(56) References Cited

U.S. PATENT DOCUMENTS

| | | | |
|---|---|---|---|
| 30,858 | A | 12/1860 | Pratt |
| 71,045 | A | 11/1867 | Nicolai |
| 105,253 | A | 7/1870 | Rodgers |
| 116,811 | A | 7/1871 | Collignon |
| 128,767 | A | 7/1872 | Viele |
| 133,503 | A | 11/1872 | Travis et al. |
| 157,028 | A | 11/1874 | Savoral |
| 169,748 | A | 11/1875 | Wakefield |
| 190,827 | A | 5/1877 | Closterman, Jr. |
| 198,421 | A | 12/1877 | Smith |
| 210,842 | A | 12/1878 | Dick |

(Continued)

FOREIGN PATENT DOCUMENTS

| | | |
|---|---|---|
| DE | 3824515 | 1/1990 |

(Continued)

OTHER PUBLICATIONS

U.S. Appl. No. 12/422,811, filed Apr. 13, 2009; Richard D. Smith; office action issued Jan. 24, 2011.

(Continued)

*Primary Examiner* — David Dunn
*Assistant Examiner* — David E Allred
(74) *Attorney, Agent, or Firm* — Thorpe North & Western LLP

(57) ABSTRACT

A stackable chair has a seat and a backrest carried between opposite frame sides each with a backrest support, a front leg and a rear leg. One or both of the seat and the backrest have a continuous sheet of flexible and elastic mesh or patterned open texture plastic held across and substantially covering an opening in an all-plastic hoop fixed between the frame sides.

30 Claims, 19 Drawing Sheets

U.S. PATENT DOCUMENTS

| | | | | | |
|---|---|---|---|---|---|
| 276,881 | A | | 5/1883 | Roberts | |
| 328,838 | A | | 10/1885 | Chichester | |
| 451,556 | A | | 5/1891 | Hallett | |
| 473,704 | A | | 1/1892 | Le Count | |
| 481,816 | A | | 8/1892 | Perry | |
| 504,446 | A | | 9/1893 | Dodd | |
| 77,327 | A | | 1/1905 | Stiggleman | |
| 779,327 | A | | 1/1905 | Stiggleman | |
| 898,235 | A | | 9/1908 | Lloyd | |
| 945,032 | A | | 1/1910 | Gillespie | |
| 976,786 | A | | 11/1910 | Moulin | |
| 1,181,357 | A | | 5/1916 | Thonet | |
| 1,291,551 | A | | 1/1919 | Kirk | |
| 1,355,669 | A | | 10/1920 | Henry | |
| 1,408,114 | A | | 2/1922 | Mathieu | |
| 1,591,550 | A | | 7/1926 | Rosenthal | |
| 1,608,911 | A | | 11/1926 | Smith | |
| D75,556 | S | | 6/1928 | Glantz | |
| 1,701,684 | A | | 2/1929 | Lee | |
| 1,730,916 | A | | 10/1929 | Cable | |
| 1,740,806 | A | | 12/1929 | Clarin | |
| 1,746,952 | A | | 2/1930 | Marwell | |
| 1,789,295 | A | | 1/1931 | Bauer | |
| 1,815,643 | A | | 7/1931 | Allerding | |
| 1,825,358 | A | | 9/1931 | Scully | |
| 1,825,368 | A | | 9/1931 | Scully | |
| 1,838,213 | A | | 12/1931 | Buffington | |
| 1,873,768 | A | | 8/1932 | Kux | |
| 1,874,434 | A | | 8/1932 | Brown | |
| 1,900,486 | A | | 3/1933 | Clarin | |
| 1,934,307 | A | | 11/1933 | Hardester | |
| 1,975,622 | A | | 10/1934 | Schermerhorn | |
| 1,989,865 | A | | 2/1935 | Johanson | |
| 1,993,601 | A | | 3/1935 | Goldberg | |
| 2,174,224 | A | | 9/1937 | Geller | |
| 2,098,888 | A | | 11/1937 | Schadler | |
| D107,545 | S | | 12/1937 | O'Connor | |
| 2,126,439 | A | | 8/1938 | Zerbee | |
| 2,127,710 | A | | 8/1938 | Baker | |
| 2,179,516 | A | * | 11/1939 | Patrick | 403/394 |
| 2,186,301 | A | | 1/1940 | La More | |
| 2,262,500 | A | | 11/1941 | Johannsen | |
| 2,303,189 | A | | 11/1942 | Adler | |
| 2,364,093 | A | | 12/1944 | O'Connor | |
| 2,364,647 | A | | 12/1944 | O'Connor | |
| 2,381,574 | A | | 8/1945 | Clarin | |
| 2,470,113 | A | * | 5/1949 | Sebel | 297/239 |
| 2,514,125 | A | | 7/1950 | Evans | |
| 2,568,269 | A | | 9/1951 | Burnham et al. | |
| 3,021,175 | A | | 2/1952 | Norquist | |
| 2,666,478 | A | | 1/1954 | Shwayder | |
| 2,699,814 | A | | 1/1955 | Kahm | |
| 2,706,517 | A | | 4/1955 | Dexter et al. | |
| 2,745,181 | A | * | 5/1956 | Czerniewicz | 33/27.03 |
| D178,900 | S | | 10/1956 | O'Neill | |
| 2,788,531 | A | | 4/1957 | Dye et al. | |
| 2,865,437 | A | | 12/1958 | Shwayder | |
| 2,874,755 | A | | 2/1959 | Smith | |
| 2,877,829 | A | | 3/1959 | Ferar et al. | |
| D186,505 | S | | 11/1959 | King et al. | |
| 2,924,830 | A | | 2/1960 | De Long | |
| 2,964,092 | A | | 12/1960 | Rassier | |
| 2,982,339 | A | | 5/1961 | Clarin | |
| 3,001,816 | A | | 9/1961 | Clarin | |
| 3,009,738 | A | | 11/1961 | Piker | |
| 3,025,102 | A | | 3/1962 | Nash | |
| 3,031,227 | A | | 4/1962 | Van Buren, Jr. | |
| 3,057,660 | A | | 10/1962 | Hans-Joachim Schneider | |
| 3,059,919 | A | | 10/1962 | Marchino | |
| 3,087,755 | A | | 4/1963 | Boman | |
| 3,094,357 | A | | 6/1963 | Shwayder | |
| 3,111,344 | A | | 11/1963 | Hoven et al. | |
| 3,123,399 | A | | 3/1964 | Wilson | |
| 3,125,156 | A | | 3/1964 | Grimshaw | |
| 3,133,762 | A | | 5/1964 | Newman | |
| 3,159,425 | A | | 12/1964 | Engstrom | |
| 3,165,359 | A | | 1/1965 | Ashkouti | |
| D200,532 | S | | 3/1965 | Williams | |
| D202,264 | S | | 9/1965 | Albinson | |
| 3,205,010 | A | | 9/1965 | Schick | |
| 3,207,551 | A | | 9/1965 | Axtell | |
| 3,220,764 | A | | 11/1965 | Duer | |
| 3,227,487 | A | | 1/1966 | Blanchard, Jr. et al. | |
| 3,233,885 | A | | 2/1966 | Propst | |
| 3,246,927 | A | | 4/1966 | Klassen | |
| 3,246,928 | A | | 4/1966 | Haynes et al. | |
| 3,278,227 | A | | 10/1966 | Rowland | |
| 3,291,523 | A | * | 12/1966 | Krueger | 297/239 |
| 3,291,529 | A | | 12/1966 | Straits | |
| 3,363,943 | A | | 1/1968 | Getz et al. | |
| 3,383,738 | A | | 5/1968 | Fox et al. | |
| 3,402,963 | A | | 9/1968 | Fujioka et al. | |
| 3,419,295 | A | | 12/1968 | Small | |
| 3,463,547 | A | | 8/1969 | Brennan et al. | |
| 3,529,866 | A | | 9/1970 | Getz | |
| 3,531,157 | A | | 9/1970 | Duckett et al. | |
| D219,032 | S | | 10/1970 | Christenson | |
| 3,540,776 | A | | 11/1970 | Wilson | |
| 3,586,277 | A | | 6/1971 | Voris, Jr. | |
| 3,610,686 | A | | 10/1971 | Caruso | |
| 3,614,157 | A | | 10/1971 | Hendrickson | |
| 3,630,572 | A | | 12/1971 | Homler | |
| 3,639,001 | A | | 2/1972 | Anderson | |
| 3,669,496 | A | | 6/1972 | Chisholm | |
| 3,669,497 | A | | 6/1972 | Massonnet | |
| 3,695,687 | A | | 10/1972 | Uyeda | |
| 3,695,694 | A | | 10/1972 | Mohr | |
| 3,695,964 | A | | 10/1972 | Shaines et al. | |
| 3,697,130 | A | | 10/1972 | Barecki et al. | |
| 3,708,202 | A | | 1/1973 | Barecki et al. | |
| 3,712,666 | A | | 1/1973 | Stoll | |
| 3,730,465 | A | | 5/1973 | Gonzalez | |
| 3,754,786 | A | | 8/1973 | Boucher et al. | |
| 3,755,853 | A | | 9/1973 | Barile | |
| 3,758,155 | A | | 9/1973 | Straits | |
| 3,774,967 | A | | 11/1973 | Rowland | |
| 3,802,734 | A | | 4/1974 | Lindley | |
| 3,813,149 | A | | 5/1974 | Lawrence et al. | |
| 3,838,884 | A | | 10/1974 | Faiks et al. | |
| 3,840,269 | A | | 10/1974 | Ambrose | |
| 3,844,517 | A | | 10/1974 | Fraser | |
| 3,845,984 | A | | 11/1974 | Rowland | |
| 3,847,433 | A | | 11/1974 | Acton et al. | |
| 3,899,207 | A | | 8/1975 | Mueller | |
| 3,904,242 | A | | 9/1975 | Koepke et al. | |
| 3,906,592 | A | | 9/1975 | Sakasegawa et al. | |
| 3,924,893 | A | | 12/1975 | Ferrara | |
| 3,939,565 | A | | 2/1976 | Bush | |
| 3,982,785 | A | * | 9/1976 | Ambasz | 297/160 |
| 4,057,288 | A | | 11/1977 | Schwartz et al. | |
| 4,062,589 | A | | 12/1977 | Klein et al. | |
| 4,064,815 | A | | 12/1977 | Baum | |
| 4,066,295 | A | | 1/1978 | Severson | |
| D249,417 | S | | 9/1978 | Ambasz | |
| 4,155,592 | A | | 5/1979 | Tsuda et al. | |
| 4,235,473 | A | | 11/1980 | Aginar | |
| 4,278,287 | A | | 7/1981 | Homestead | |
| 4,291,855 | A | | 9/1981 | Schenkel et al. | |
| 4,304,436 | A | * | 12/1981 | Rowland | 297/239 |
| 4,318,570 | A | | 3/1982 | Adam et al. | |
| 4,319,779 | A | | 3/1982 | Leonhart | |
| 4,325,577 | A | | 4/1982 | Thebaud | |
| 4,359,809 | A | | 11/1982 | Fraser | |
| 4,368,917 | A | | 1/1983 | Urai | |
| 4,382,453 | A | | 5/1983 | Bujan et al. | |
| 4,383,486 | A | | 5/1983 | Reineman et al. | |
| 4,386,804 | A | | 6/1983 | Ware et al. | |
| 4,400,031 | A | | 8/1983 | DeDecker | |
| 4,407,479 | A | | 10/1983 | Combe | |
| 4,451,085 | A | | 5/1984 | Franck et al. | |
| 4,456,296 | A | | 6/1984 | Rowland | |
| D275,533 | S | | 9/1984 | Lantz | |
| 4,498,702 | A | | 2/1985 | Raftery | |
| 4,502,731 | A | | 3/1985 | Snider | |
| 4,510,634 | A | | 4/1985 | Diedrich et al. | |
| 4,533,174 | A | | 8/1985 | Fleishman | |
| 4,536,102 | A | * | 8/1985 | Doyle | 403/390 |

4,541,150 A 9/1985 Brokmann
4,549,764 A 10/1985 Haedo
4,557,521 A 12/1985 Lange
4,558,904 A 12/1985 Schultz
4,561,622 A 12/1985 Heinzel
4,564,163 A 1/1986 Barnett
4,569,496 A 2/1986 Fleishman
4,580,836 A 4/1986 Verney
4,583,778 A 4/1986 Liebhold
4,585,272 A 4/1986 Ballarini
4,601,516 A 7/1986 Klein
4,603,904 A 8/1986 Tolleson et al.
4,603,907 A 8/1986 Witzke
4,617,869 A 10/1986 Denomey
4,624,432 A 11/1986 Salacuse
4,630,865 A 12/1986 Ahs
4,639,042 A 1/1987 Lange
4,648,653 A 3/1987 Rowland
4,655,504 A 4/1987 Weber
4,660,887 A 4/1987 Fleming et al.
D290,070 S 6/1987 Lange
4,684,172 A 8/1987 Lundquist
4,747,569 A 5/1988 Hoshino
4,756,575 A 7/1988 Dicks
4,790,595 A 12/1988 Hensel et al.
D300,885 S 5/1989 Ochsner
4,830,250 A 5/1989 Newbold et al.
4,837,878 A 6/1989 Huemer
4,852,944 A 8/1989 Hartmann
4,869,552 A 9/1989 Tolleson et al.
4,881,705 A 11/1989 Kraus
4,883,320 A 11/1989 Izumida et al.
4,900,183 A * 2/1990 Souchko ..... 403/385
4,913,493 A 4/1990 Heidmann
4,923,158 A 5/1990 Saisho
4,953,913 A 9/1990 Graebe
4,962,964 A 10/1990 Snodgrass
4,978,168 A 12/1990 Piretti
5,002,337 A * 3/1991 Engel et al. ..... 297/239
5,013,089 A 5/1991 Abu-Isa et al.
5,020,749 A 6/1991 Kraus
5,039,163 A 8/1991 Tolleson
5,040,848 A 8/1991 Irie et al.
5,056,699 A 10/1991 Newbold et al.
5,062,179 A 11/1991 Huang
5,064,247 A 11/1991 Clark et al.
5,071,191 A 12/1991 Leib
5,096,259 A 3/1992 Stanfield
5,108,149 A 4/1992 Ambasz
5,110,186 A 5/1992 Clark et al.
5,113,717 A 5/1992 Plamper
5,123,702 A 6/1992 Caruso
5,131,607 A 7/1992 Arnold et al.
5,146,656 A 9/1992 Huang
5,154,485 A 10/1992 Fleishman
5,183,314 A 2/1993 Lorbiecki
5,211,323 A 5/1993 Chimenti et al.
5,213,004 A 5/1993 Hoblingre
D337,444 S 7/1993 Lamalle
5,234,185 A 8/1993 Hoffman et al.
5,265,969 A 11/1993 Chuang
5,277,387 A 1/1994 Lewis et al.
5,282,669 A 2/1994 Barile
5,297,851 A 3/1994 Van Hekken
5,323,713 A 6/1994 Luyk et al.
5,356,204 A 10/1994 McDonough
5,367,815 A 11/1994 Liou
5,382,080 A 1/1995 Gamberini et al.
5,383,712 A 1/1995 Perry
5,393,126 A 2/1995 Boulva
D357,365 S 4/1995 Ward et al.
5,413,015 A 5/1995 Zentmyer
5,427,469 A * 6/1995 Galarnyk ..... 403/396
5,497,537 A 3/1996 Robinson et al.
5,498,098 A * 3/1996 Cairns ..... 403/400
5,499,883 A 3/1996 Heinzel
5,503,455 A 4/1996 Yang
5,513,899 A 5/1996 Michaels et al.
5,520,474 A 5/1996 Liu
5,524,963 A 6/1996 Barile
5,524,966 A 6/1996 Piretti
5,542,159 A 8/1996 Schultz et al.
5,549,358 A 8/1996 Muller
5,560,678 A 10/1996 Eppelt
5,611,598 A 3/1997 Knoblock
5,662,383 A 9/1997 Hand
5,681,093 A 10/1997 Pfister
5,701,971 A * 12/1997 Rchid ..... 182/179.1
5,738,408 A 4/1998 Wu
5,747,140 A 5/1998 Heerklotz
5,762,403 A 6/1998 Robinson
5,779,317 A 7/1998 Neal
5,785,287 A 7/1998 Hoshino
5,820,221 A 10/1998 Greaves et al.
5,825,095 A 10/1998 Albecker, III
5,826,312 A 10/1998 Schroder et al.
5,842,739 A 12/1998 Noble
5,845,589 A 12/1998 Pfister
5,845,970 A 12/1998 Schwartz
5,860,697 A 1/1999 Fewchuk
5,860,700 A 1/1999 Lance
5,863,096 A * 1/1999 Bartlmae ..... 297/248
5,871,258 A 2/1999 Battey et al.
D406,195 S 3/1999 Gamberini
5,887,946 A 3/1999 Raftery
5,902,012 A 5/1999 Han
5,904,397 A 5/1999 Fismen
5,934,758 A 8/1999 Ritch et al.
5,947,562 A 9/1999 Christofferson et al.
5,954,391 A 9/1999 Gray
5,961,184 A 10/1999 Balderi et al.
5,964,443 A 10/1999 Leveille
5,967,605 A 10/1999 Stanfield
5,975,626 A 11/1999 Aycock
5,975,634 A 11/1999 Knoblock et al.
5,988,746 A 11/1999 Raftery
5,988,757 A 11/1999 Vishey et al.
5,997,084 A 12/1999 Barile et al.
6,003,948 A 12/1999 Holbrook
D418,322 S 1/2000 Hock
6,012,679 A 1/2000 Auestad
6,030,037 A 2/2000 Ritch et al.
6,035,901 A 3/2000 Stumpf et al.
6,050,646 A 4/2000 Stenzel et al.
D425,717 S 5/2000 Tseng
6,056,354 A 5/2000 Tseng
6,059,368 A 5/2000 Stumpf et al.
6,065,803 A 5/2000 Li et al.
6,070,940 A 6/2000 Wu
6,095,386 A * 8/2000 Kuo ..... 224/448
6,095,597 A 8/2000 Huang
6,099,073 A 8/2000 Bruschi
6,102,482 A 8/2000 Dettoni et al.
6,106,061 A * 8/2000 Caruso et al. ..... 297/239
6,113,186 A 9/2000 Holmes et al.
6,116,692 A 9/2000 Tarnay et al.
6,116,694 A 9/2000 Bullard
D431,400 S 10/2000 Grove
D432,805 S 10/2000 Smith
6,125,521 A 10/2000 Stumpf et al.
6,135,562 A 10/2000 Infanti
D435,977 S 1/2001 Ambasz
D436,457 S 1/2001 Ambasz
D437,501 S 2/2001 Rehmert et al.
6,206,469 B1 3/2001 Caruso et al.
D440,784 S 4/2001 Ambasz
6,234,571 B1 5/2001 Atkins et al.
6,234,578 B1 5/2001 Barton et al.
6,254,190 B1 7/2001 Gregory
D446,661 S 8/2001 Ambasz
6,279,991 B1 8/2001 Atkins et al.
6,279,998 B1 8/2001 Chu et al.
6,305,742 B1 10/2001 Spendlove et al.
6,305,750 B1 10/2001 Buono et al.
D452,619 S 1/2002 Piretti
6,338,587 B1 1/2002 Kuo
6,345,863 B1 2/2002 Laws et al.
6,349,992 B1 2/2002 Knoblock et al.

6,378,944 B1 4/2002 Weisser
6,382,728 B1 5/2002 Buono
6,386,627 B1 5/2002 Tsai
6,386,634 B1 5/2002 Stumpf et al.
6,406,096 B1 6/2002 Barile, Sr.
6,409,268 B1 6/2002 Cvek
D460,300 S 7/2002 Fifield et al.
6,412,869 B1 7/2002 Pearce
6,422,645 B1 7/2002 Smith et al.
6,439,665 B1 8/2002 Cvek
6,471,293 B2 10/2002 Ware et al.
D465,938 S 11/2002 Huang
D465,940 S 11/2002 Nien
6,481,789 B1 11/2002 Ambasz
D466,712 S 12/2002 Haney et al.
D469,969 S 2/2003 Glass et al.
D469,971 S 2/2003 Piretti
6,523,898 B1 2/2003 Ball et al.
6,533,352 B1 3/2003 Glass et al.
6,536,079 B2 3/2003 Hill
D473,727 S 4/2003 Tsai
6,543,842 B2 4/2003 Haney
6,547,321 B2 4/2003 Wu
6,550,866 B1 4/2003 Su
6,561,580 B1 5/2003 Bergey
D476,162 S 6/2003 Finazzi
D477,470 S 7/2003 Haney et al.
6,585,323 B2 7/2003 Gaylord et al.
6,588,842 B2 7/2003 Stumpf et al.
6,598,544 B2 7/2003 Laws et al.
6,604,784 B1 8/2003 Bosman et al.
6,612,654 B2 9/2003 Laws et al.
D481,879 S 11/2003 Su
6,644,749 B2 11/2003 VanDeRiet et al.
6,666,518 B2 * 12/2003 Bruschi et al. ..... 297/440.14
6,669,281 B1 12/2003 Huang
6,688,698 B1 2/2004 Chou et al.
6,702,390 B2 3/2004 Stumpf et al.
6,709,050 B2 * 3/2004 Huang ..... 297/57
6,722,741 B2 4/2004 Stumpf et al.
6,722,742 B2 4/2004 Potes et al.
6,726,285 B2 4/2004 Caruso et al.
6,726,286 B2 4/2004 Sayers et al.
6,729,691 B2 5/2004 Koepke et al.
6,733,080 B2 5/2004 Stumpf et al.
6,742,839 B2 6/2004 Piretti
6,755,468 B1 6/2004 Pan
D494,792 S 8/2004 Schmitz et al.
6,779,846 B2 8/2004 Spendlove et al.
D495,509 S 9/2004 Breen
D495,891 S 9/2004 Ambasz
6,837,546 B2 * 1/2005 VanDeRiet et al. ..... 297/440.1
D501,613 S 2/2005 Kaltenmark et al.
D503,291 S 3/2005 Lucci et al.
6,863,341 B1 3/2005 Wen
6,866,338 B2 3/2005 Mendenhall et al.
6,871,906 B2 3/2005 Haney
6,886,890 B2 5/2005 Rowland et al.
6,890,026 B1 5/2005 Shin
6,899,053 B2 5/2005 Hawkins
6,899,396 B2 5/2005 Bales
D505,800 S 6/2005 Lucci et al.
D506,325 S 6/2005 Farber et al.
6,908,159 B2 6/2005 Prince et al.
D507,425 S 7/2005 Ashby et al.
6,923,505 B2 8/2005 Siminovitch et al.
6,935,698 B1 8/2005 Chen
6,942,300 B2 9/2005 Numa et al.
6,957,861 B1 10/2005 Chou et al.
6,966,606 B2 11/2005 Coffield
D513,456 S 1/2006 Smith
6,983,997 B2 1/2006 Wilkerson et al.
6,988,774 B1 1/2006 Elzenbeck
7,021,712 B2 4/2006 Spendlove et al.
7,029,064 B2 4/2006 Chen
D523,254 S 6/2006 Nye et al.
7,059,670 B2 6/2006 Mills et al.
7,066,536 B2 6/2006 Williams et al.
7,066,550 B1 6/2006 Su
7,073,864 B2 7/2006 Olsen
D526,136 S 8/2006 Kettler et al.
D526,138 S 8/2006 Rech
7,104,604 B1 9/2006 Kang
7,107,915 B2 9/2006 Laws et al.
7,111,906 B2 9/2006 Heisey et al.
D532,986 S 12/2006 Kettler et al.
D533,000 S 12/2006 Lu et al.
7,147,286 B2 12/2006 Cesaroni et al.
7,152,929 B2 12/2006 Wu
7,156,459 B2 1/2007 Ambasz
D539,557 S 4/2007 Doughty
D541,068 S 4/2007 Fother
D544,225 S 6/2007 Cantarutti
D544,235 S 6/2007 Chen
7,249,802 B2 7/2007 Schmitz et al.
7,303,230 B2 12/2007 Munn et al.
7,303,235 B1 12/2007 Fongers
D558,999 S 1/2008 Cantarutti
D567,524 S 4/2008 Marin
D569,121 S 5/2008 Rizzi
7,396,076 B1 7/2008 Hock
7,396,078 B2 7/2008 Weber et al.
7,406,733 B2 8/2008 Coffield et al.
D580,673 S 11/2008 Wright et al.
D581,708 S 12/2008 Su
7,458,918 B1 12/2008 Clark
7,472,962 B2 1/2009 Caruso et al.
7,513,567 B2 4/2009 Huang
D594,669 S 6/2009 Asano
7,552,968 B2 6/2009 Smith et al.
D599,127 S 9/2009 Smith
D600,936 S 9/2009 Koh
7,717,511 B2 5/2010 Huang
7,758,112 B2 7/2010 Huang
7,810,882 B2 * 10/2010 Bartlmae et al. ..... 297/248
7,896,431 B2 3/2011 Cui et al.
7,988,228 B2 8/2011 Cui et al.
2001/0028188 A1 10/2001 Stumpf et al.
2001/0030457 A1 10/2001 Gregory
2001/0033100 A1 10/2001 Haney
2002/0053822 A1 5/2002 Ware et al.
2002/0109380 A1 * 8/2002 VanDeRiet et al. ..... 297/239
2002/0117883 A1 8/2002 Gevaert
2002/0145326 A1 10/2002 Liu
2002/0195863 A1 12/2002 Su
2003/0071509 A1 4/2003 Neil et al.
2003/0090137 A1 * 5/2003 Piretti ..... 297/335
2003/0108385 A1 * 6/2003 Finco et al. ..... 403/396
2003/0127887 A1 7/2003 Laws et al.
2003/0168894 A1 9/2003 Lin
2003/0218372 A1 * 11/2003 Balliu Falgueras ..... 297/377
2003/0234563 A1 12/2003 Huang
2004/0076465 A1 4/2004 Geiger
2004/0245842 A1 12/2004 Nardi
2004/0262975 A1 12/2004 Su
2005/0001464 A1 1/2005 Caruso et al.
2005/0045786 A1 * 3/2005 Tupper et al. ..... 248/229.2
2005/0077773 A1 4/2005 Chen
2005/0146193 A1 7/2005 Shieh
2005/0175403 A1 8/2005 Herb et al.
2005/0206210 A1 9/2005 Coffield
2005/0264087 A1 12/2005 Diffrient
2006/0006715 A1 1/2006 Chadwick et al.
2006/0091715 A1 5/2006 Schmitz et al.
2006/0138849 A1 6/2006 Wilkerson et al.
2006/0284469 A1 12/2006 Lowsky
2007/0000112 A1 1/2007 Johnson et al.
2007/0132291 A1 6/2007 Smith et al.
2007/0132302 A1 6/2007 Smith et al.
2007/0222266 A1 9/2007 Lucci et al.
2008/0277982 A1 * 11/2008 Bartlmae ..... 297/239
2008/0315645 A1 * 12/2008 Hock ..... 297/239
2008/0315646 A1 * 12/2008 Hock ..... 297/239
2009/0079235 A1 * 3/2009 Huang ..... 297/42
2009/0146467 A1 6/2009 Waite et al.
2009/0184548 A1 7/2009 Vickers et al.
2009/0236895 A1 9/2009 Bottemiller
2010/0176633 A1 7/2010 Brncick et al.

| | | | |
|---|---|---|---|
| 2010/0194160 | A1 | 8/2010 | Machael et al. |
| 2010/0237582 | A1 | 9/2010 | Belenkov et al. |
| 2011/0025104 | A1 | 2/2011 | Fusao et al. |
| 2011/0175412 | A1 | 7/2011 | Piretti |
| 2011/0187169 | A1 | 8/2011 | Stewart et al. |

FOREIGN PATENT DOCUMENTS

| | | | |
|---|---|---|---|
| DE | 3824515 | A1 * | 1/1990 |
| DE | 4135603 | | 5/1992 |
| EP | 210710 | | 2/1987 |
| JP | 06269330 | | 9/1994 |
| WO | WO 2004/037046 | | 5/2004 |

OTHER PUBLICATIONS

U.S. Appl. No. 12/422,821, filed Apr. 13, 2009; Richard D. Smith; office action issued Jan. 7, 2011.
U.S. Appl. No. 12/422,801, filed Apr. 13, 2009; Richard D. Smith; office action issued Jan. 19, 2011.
U.S. Appl. No. 29/346,705, filed Nov. 4, 2009; Richard D. Smith; office action issued Feb. 3, 2011.
U.S. Appl. No. 12/422,792, filed Apr. 13, 2009; Richard D. Smith; office action issued Jan. 19, 2011.
Smith, Richard et al., U.S. Appl. No. 12/755,995, filed Apr. 7, 2010.
Smith, Richard et al., U.S. Appl. No. 12/755,954, filed Apr. 7, 2010.
Smith, Richard et al., U.S. Appl. No. 12/748,823, filed Mar. 29, 2010.
Smith, Richard et al., U.S. Appl. No. 12/757,218, filed Apr. 9, 2010.
U.S. Appl. No. 12/422,811, filed Apr. 13, 2009; Richard D. Smith; Notice of Allowance issued Jun. 29, 2011.
U.S. Appl. No. 12/422,821, filed Apr. 13, 2009; Richard D. Smith; Notice of Allowance issued Jul. 7, 2011.
U.S. Appl. No. 12/422,801, filed Apr. 13, 2009; Richard D. Smith; Notice of Allowance issued Jul. 13, 2011.
U.S. Appl. No. 12/422,792, filed Apr. 13, 2009; Richard D. Smith; Notice of Allowance issued Jul. 17, 2011.
U.S. Appl. No. 29/346,705, filed Nov. 4, 2009; Richard D. Smith; Notice of Allowance issued Jul. 18, 2011.
Herman Miller for business—Mirra Chairs, www.hermanmiller.com/CDA/SSA/Product? 0,,a10-c440-p205,00.html, accessed Apr. 8, 2009, 3 pages.
Home Alexander Folding Rockers Set of 2: Target, www.target.com/Home-Alexander-Folding-Rockers-Set/dp/B001CS96AY/qid=1233 . . . accessed Jan. 29, 2009, 4 pages.
Ergo Mesh Folding Guest Chair (Set of 2) from Overstock.com, www.overstock.com/Office-Furniture/Ergo-Mesh-Folding-Guest-Chair-Set of 2/308 . . . , accessed Jan. 29, 2009 3 pages.
Mesh folding chair, mesh chairs, custom chairs, folding camp chairs, custom foldin . . . , www.staplespromotionalproducts.com/ProductDetail.aaspx?id=358, accessed Jan. 29, 2009, 1 page.
Home wrought iron fold chair—set of 4: Target, www.target.com/Home-Wrought-Iron-Fold-Chari/dp/B0011ZS8WS/qid=123326645.., accessed Jan. 29, 2009 2 pages.
Herman Miller—for buisness—aeron chairs, www.hermanmiller.com/CDA/SSA/Product/1,1592,a10-c440-p8,00.html, accessed Jan. 29, 2009, 4 pages.
Aeron chairs, Herman Miller aeron chair, aeron loaded chairs & aeron chair accesso . . . , www.hermanmillerseating.com/aeron%AE-C79906.html?refid=G2772.%22herman . . . accessed Jan. 29, 2009, 4 pages.
Smith, Richard et al., U.S. Appl. No. 12/422,801, filed Apr. 13, 2009.
Smith, Richard et al., U.S. Appl. No. 12/422,811, filed Apr. 13, 2009.
Smith, Richard et al., U.S. Appl. No. 12/422,821, filed Apr. 13, 2009.
Smith, Richard et al., U.S. Appl. No. 29/335,295, filed Apr. 13, 2009.
Smith, Richard et al., U.S. Appl. No. 29/346,705, filed Nov. 4, 2009.
Smith, Richard et al., U.S. Appl. No. 12/612,257, filed Nov. 4, 2009.
Smith, Richard et al., U.S. Appl. No. 12/422,792, filed Apr. 13, 2009.
http://sstores.advancesinteriordesings.com/-strse-972/Mesh-Folding-Chair,-Suave/Detail.bok, Advances Interior Designs—Modern HOme and Office FUrniture, accessed Oct. 2009, 1 page.
DuraMesh Folding Chair, KI A versatile folding chair with a comfortable, durable mesh seat, www.ki.com, accessed Oct. 2009, 2 pages.
U.S. Appl. No. 13/245,339, filed Sep. 26, 2011; Richard D. Smith; Office Action issued Jan. 19, 2012.
U.S. Appl. No. 12,612,257, filed Jan. 4, 2009; Richard D. Smith; Office Action issued Feb. 13, 2012.
U.S. Appl. No. 29/379,237, filed Nov. 16, 2010; Richard D. Smith; Notice of Allowance issued Feb. 24, 2012.
U.S. Appl. No. 12/612,257; filed Nov. 4, 2009; Richard D. Smith; notice of allowance dated Jul. 23, 2012.
U.S. Appl. No. 13/245,339; filed Sep. 26, 2011; Richard D. Smith; office action dated Jul. 18, 2012.

* cited by examiner

MESH STACKING CHAIR

PRIORITY CLAIM

Priority is claimed to U.S. Provisional Patent Application Ser. No. 61/168,837, filed Apr. 13, 2009, which is hereby incorporated herein by reference in its entirety.

Priority is claimed to U.S. Provisional Patent Application Ser. No. 61/140,756, filed Dec. 24, 2008, which is hereby incorporated herein by reference in its entirety.

This is a continuation-in-part of U.S. patent application Ser. No. 12/422,792 now U.S. Pat. No. 8,033,598; Ser. No. 12/422,801 now U.S. Pat. No. 8,033,612; Ser. No. 12/422,811 now U.S. Pat. No. 8,029,059; and Ser. No. 12/422,821 now U.S. Pat. No. 8,038,221; all filed Apr. 13, 2009, and which all claim priority to U.S. Provisional Patent Application Ser. No. 61/140,756, filed Dec. 24, 2008, and which all are hereby incorporated herein by reference in their entirety.

CROSS-REFERENCE TO RELATED APPLICATIONS

U.S. patent application Ser. No. 12/612,257, filed Nov. 4, 2009, and entitled "Clamping Joint for Chair" which is hereby incorporated herein by reference in its entirety.

U.S. Design patent application Ser. No. 29/346,705, filed Nov. 4, 2009, and entitled "Mesh Stacking Chair" which is hereby incorporated herein by reference in its entirety.

BACKGROUND

1. Field of the Invention

The present invention relates generally to a mesh stacking chair with a joint connecting the legs to the seat.

2. Related Art

Stacking chairs are often used in situations in which it is desirable or necessary to provide varying numbers and/or varying layouts of chairs, such as during conventions, seminars, conferences, etc. In addition, stacking chairs are often used in multipurpose areas in which patron seating is required for some functions, but a large open space is required for other functions necessitating storage of the chairs. For example, some organizations have buildings with a multipurpose room which may be used for banquets, seminars, conventions, etc., with chairs set up, or for a dance, sporting event, etc., with the stacking chairs removed. Furthermore, stacking chairs are often used domestically/residentially to accommodate larger dinner-parties or the like.

It is desirable that the stacking chairs be capable of being stacked for storage so that the chairs take up less room when they are not required. It will be appreciated that some situations or events will require hundreds or even thousands of chairs, all of which may need to be stored at any given period. Thus, the chairs must be stored such that they have a high storage density to minimize the storage space required. It will be appreciated that numerous stacked chairs can be difficult to handle or store, and may separate from one another. Furthermore, it will be appreciated that chairs can be unsymmetrical so that stacking several chairs together results in a non-linear stack which can lead to separation.

In addition, it is desirable that the chairs be easily storable or stackable, and be stable when stored/stacked. Many typical prior art folding chairs are stored merely by leaning one chair against a wall and subsequent chairs in a series against the first chair. It will be appreciated that a plurality of folding chairs stacked against a wall has a potential domino effect, with all of the chairs subject to being knocked over. Other prior art folding chairs have complicated and expensive hanging rack systems. For example, a wheeled cart might have a plurality of support arms from which a plurality of folding chairs is suspended. One disadvantage of these types of systems is that chairs on the end of the hangers tend to fall off the rack, and the wheeled racks are difficult to move and maneuver.

It also is desirable that the chairs be comfortable. Typical prior art chairs can have rigid metal seats and seat backs which can be hard and uncomfortable. One disadvantage of many prior art chairs is that the chairs either fold or stack and are uncomfortable, or are comfortable but are incapable or awkward in stacking. Thus, there tends to be a trade off between comfort and stackability. Some chairs provide a cushion. But these chairs still utilize the rigid metal seat bottoms and seat backs, and the cushions tend to make the chairs even thicker. For example, see U.S. Pat. Nos. 2,877,829 and D357,365.

Other types of chairs, such as office chairs, have been design for greater comfort and aesthetic appearance, but which do not stack. For example, see U.S. Pat. Nos. 6,125,521 and 7,249,802.

Furthermore, it will be appreciated that such chairs can be made and shipped in great quantities, and that such stacking chairs can occupy a large volume, resulting in shipping expense or inefficiencies.

SUMMARY OF THE INVENTION

It has been recognized that it would be advantageous to develop a chair with greater comfort while maintaining high density storage and providing for stackability. In addition, it has been recognized that it would be advantageous to develop a chair utilizing a mesh seating surface for comfort and space saving in a stacked configuration. In addition, it has been recognized that it would be advantageous to develop a chair utilizing the comfort of a mesh seating surface in a stacking chair. In addition, it has been recognized that it would be advantageous to develop such a stacking chair with a mesh seating surface that is both economically viable and structurally sound. Furthermore, it has been recognized that it would be advantageous to develop a chair shippable in a disassembled, but ready to assemble, configuration in a thin, knock down box, and that is easily and quickly assembled with few parts.

The invention provides a stackable chair with a seat and a backrest carried between opposite frame sides, each with a backrest support, a front leg and a rear leg. The front and rear legs are fixed in a spaced apart relationship from one another, with the front and rear legs being inclined outwardly to facilitate stacking with another chair. One or both of the seat and the backrest have a continuous sheet of flexible and elastic mesh or patterned open texture plastic held across and substantially covering an opening in an all-plastic hoop fixed between the frame sides.

In accordance with a more detailed aspect of the present invention, the chair includes one of the front or rear legs being outside of the other with respect to the seat, and with one of the front or rear legs overlapping the other at an overlap. A joint couples the legs to the seat, including an inner clamp coupled to the seat and an outer clamp coupled to the inner clamp. The front leg and the rear leg are clamped between the inner and outer clamps at the overlap. A finger on one of the inner or outer clamps extends toward the other, and is disposed between the front and rear legs.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Most or all of the mesh or patterned plastic has been removed from the figures for clarity of the chair, seat, backrest and hoops. But the mesh or patterned plastic is understood to extend across the entire opening of the hoops.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

As illustrated in FIGS. 1*a-h*, a stacking chair, indicated generally at 10, with a seat 14 and a backrest 18 is shown in an example implementation in accordance with the invention. Such a stacking chair can be utilized by institutions or residentially. The seat 14 and backrest 18 can have a stretched mesh over all-plastic frames or hoops to achieve upholstered comfort in a non-upholstered stacking chair. In addition, the chair can use the all-plastic frames with mesh for the seat and the backrest supported by a metal frame and legs for a sturdy, strong, and light-weight chair. In addition, the metal frame and/or legs can be secured to the seat hoop by a joint where the front and rear legs overlap. The chair, or its components, can be shipped in a flat, knock-down box and can be ready to assemble (RTA). The chair can be easily and quickly assembled by placing the legs in the joint and attaching an outer clamp of the joint and snap fitting the backrest. The chair, or its components, can be provided and assembled without welding and without cross leg supports between the front legs or the rear legs. Furthermore, the seat can have a broadly curved front and upper edge, or waterfall edge, to resist a hard surface against a backside of a user's leg. Furthermore, the final shape of mesh back provides lumbar support. The chair of the present invention provides a comfortable seating experience that can be stacked with other chairs and that can be shipped in a flat, knock-down box and can be ready to assemble (RTA).

Figure 1A:
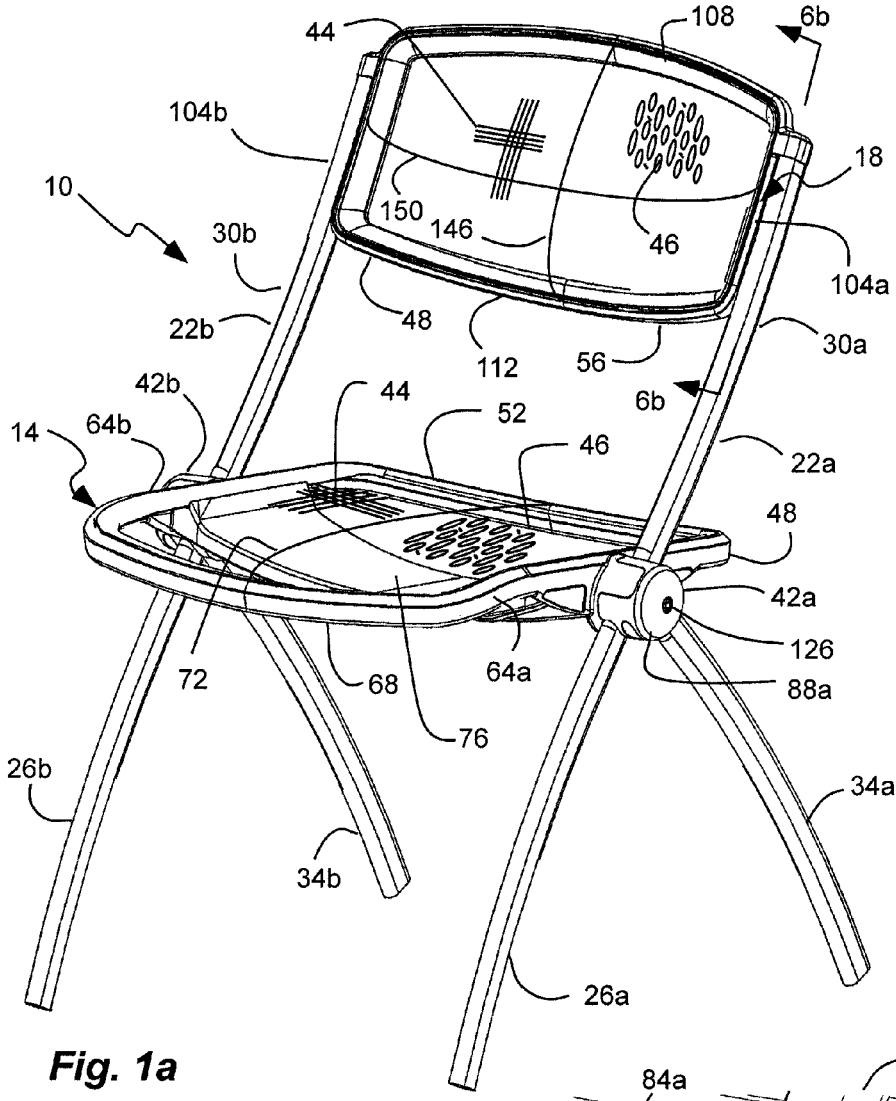
FIG. 1*a* is a perspective view of a stacking chair in accordance with an embodiment of the present invention and with mesh of the seat and backrest mostly removed for clarity.
Figure 1B:
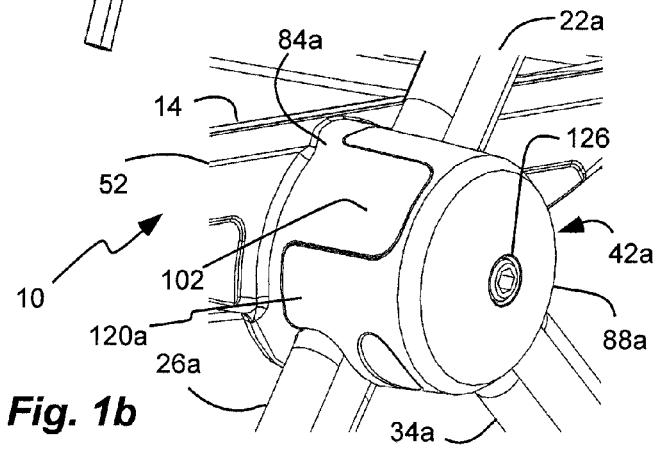
FIG. 1*b* is detailed view of a joint of the stacking chair of FIG. 1*a;*
Figure 1C:
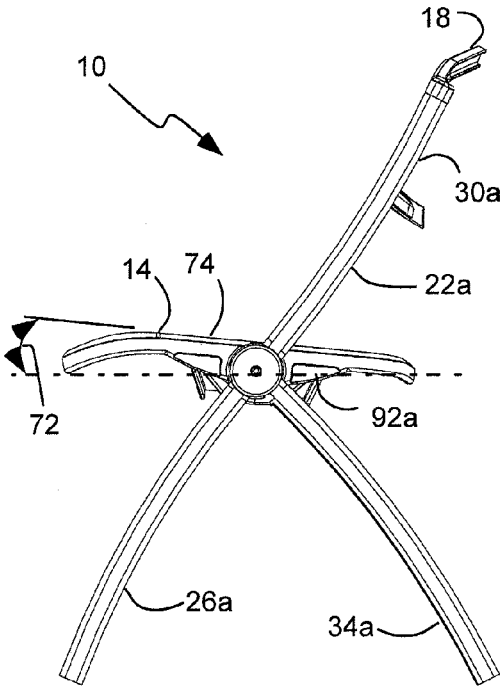
FIG. 1*c* is a side view of the stacking chair of FIG. 1*a;*
Figure 1D:
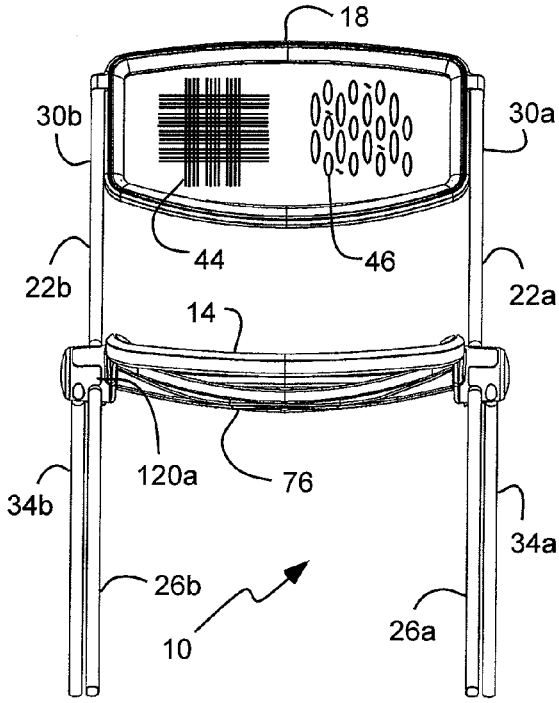
FIG. 1*d* is a front view of the stacking chair of FIG. 1*a;*
Figure 1F:
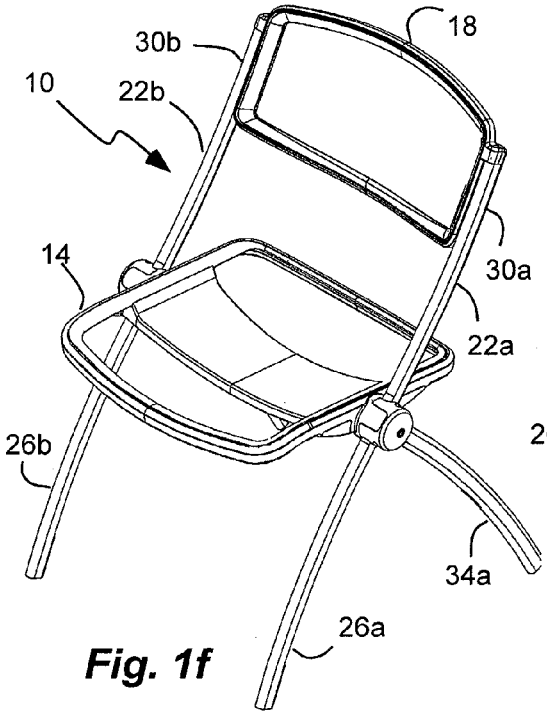
FIG. 1*f* is a perspective view of the stacking chair of FIG. 1*a;*
Figure 1E:
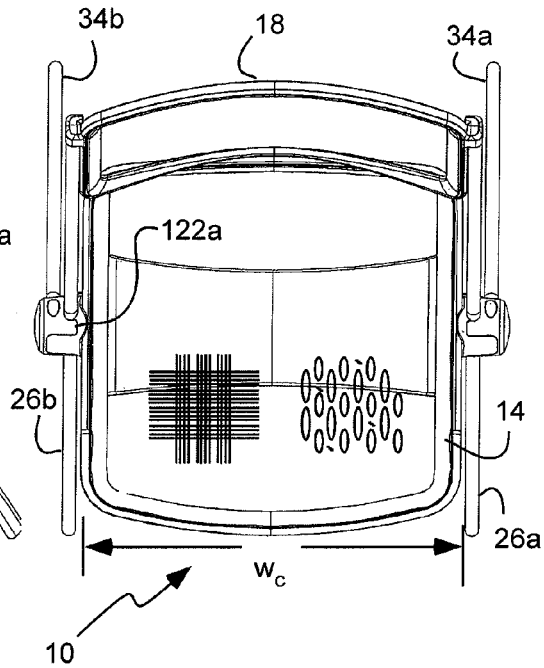
FIG. 1*e* is a top view of the stacking chair of FIG. 1*a;*
Figure 1G:
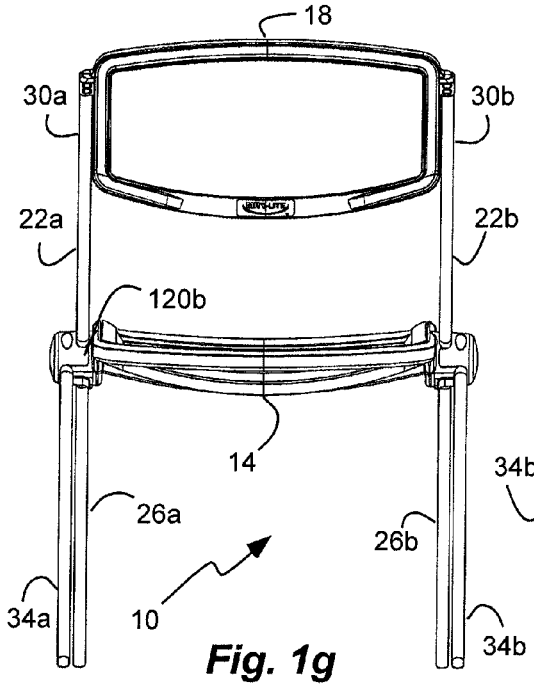
FIG. 1*g* is a rear view of the stacking chair of FIG. 1*a;*
Figure 1H:
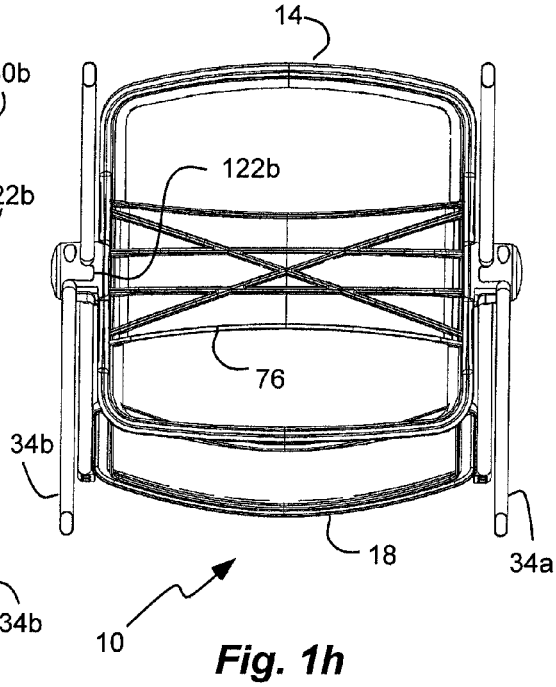
FIG. 1*h* is a bottom view of the stacking chair of FIG. 1*a;*
Figure 2A:
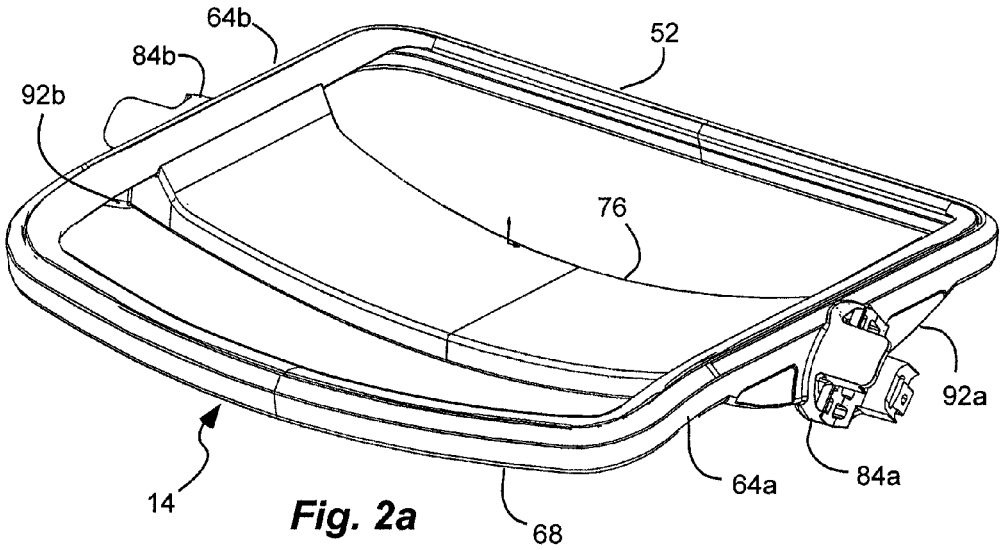
FIG. 2*a* is a perspective view of the seat of the stacking chair of FIG. 1*a;*
Figure 2B:
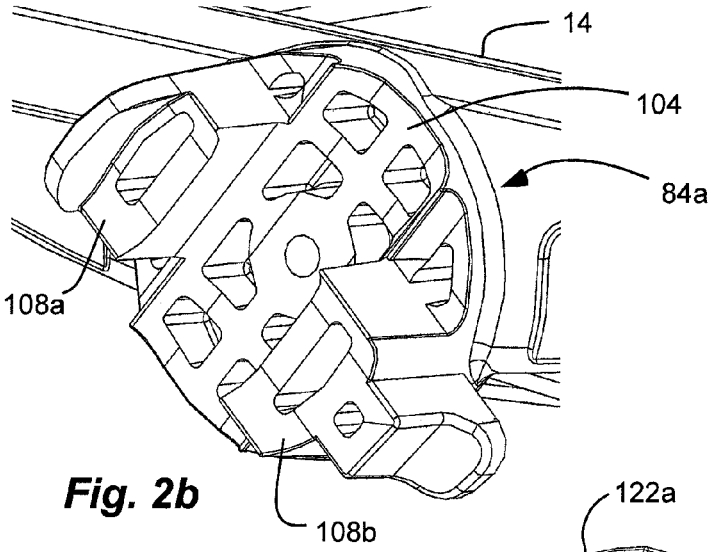
FIG. 2*b* is a detailed perspective view of an inner clamp of a joint of the seat of FIG. 2*a* with an outer clamp and legs removed.
Figure 3:
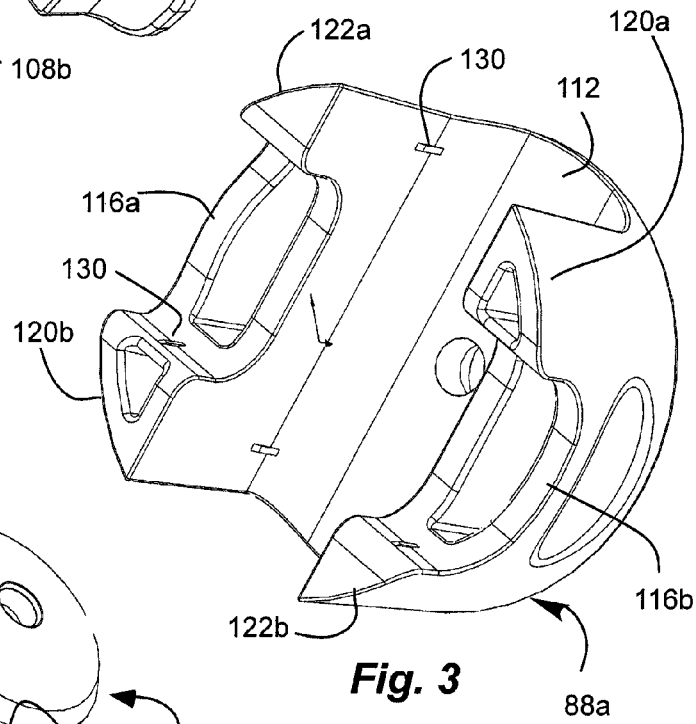
FIG. 3 is a detailed perspective view of an outer clamp of the joint of FIG. 1*a;*
Figure 4:
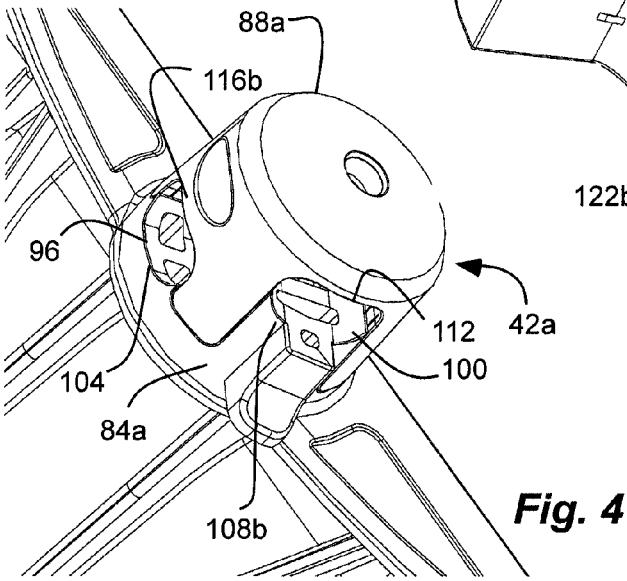
FIG. 4 is a detailed perspective view of the joint of the chair of FIG. 1*a*, with the legs removed.
Figure 5A:
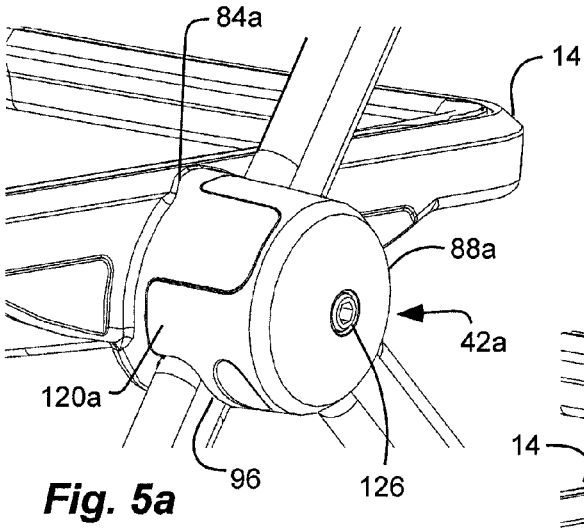
FIG. 5*a* is a detailed perspective view of the joint of the chair of FIG. 1*a;*
Figure 5B:
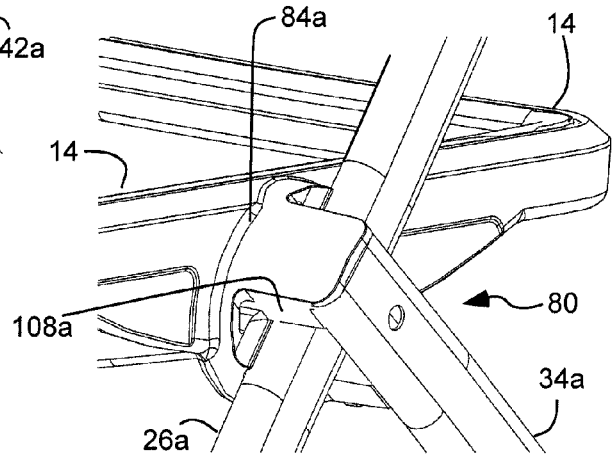
FIG. 5*b* is a detailed perspective view of the joint of FIG. 5*a* with the outer clamp removed.
Figure 5C:
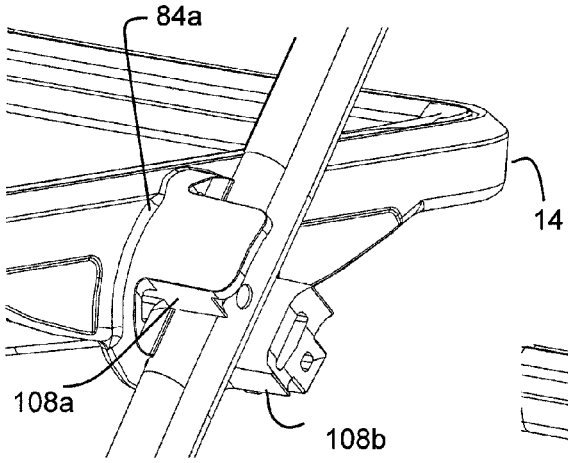
FIG. 5*c* is a detailed perspective view of the joint of FIG. 5*b* with the rear leg removed.
Figure 5D:
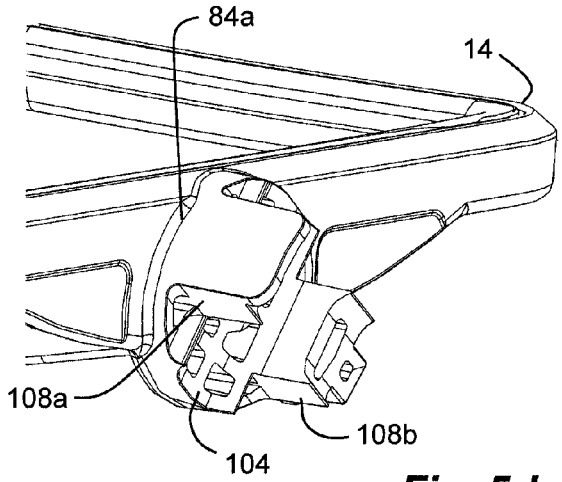
FIG. 5*d* is a detailed perspective view of the joint of FIG. 5*c* with the front leg removed.
Figure 5E:
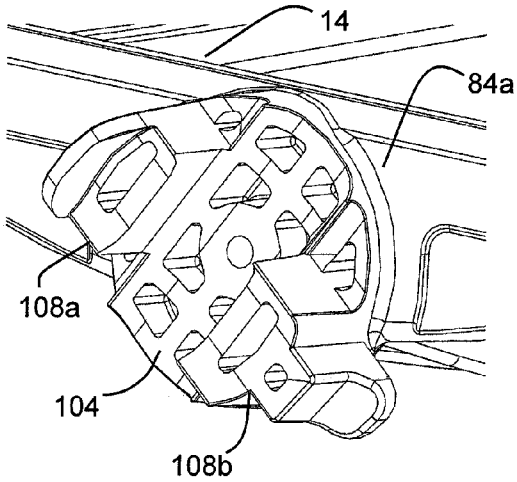
FIG. 5*e* is a detailed perspective view of the joint of FIG. 1*a* with the front and rear legs and the outer clamp removed.
Figure 5F:
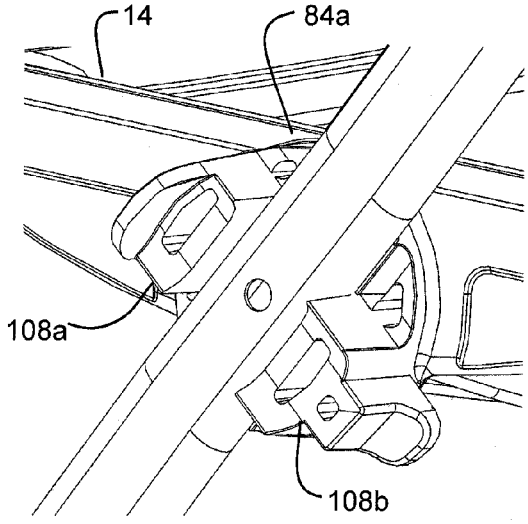
FIG. 5*f* is a detailed perspective view of the joint of FIG. 5*e* with the front leg added, and the rear leg and outer clamp removed.
Figure 5G:
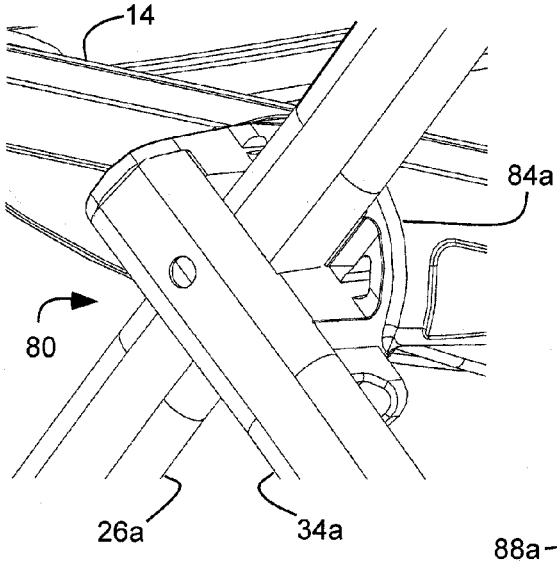
FIG. 5*g* is a detailed perspective view of the joint of FIG. 5*f* with the rear leg added, and the outer clamp removed.
Figure 5H:
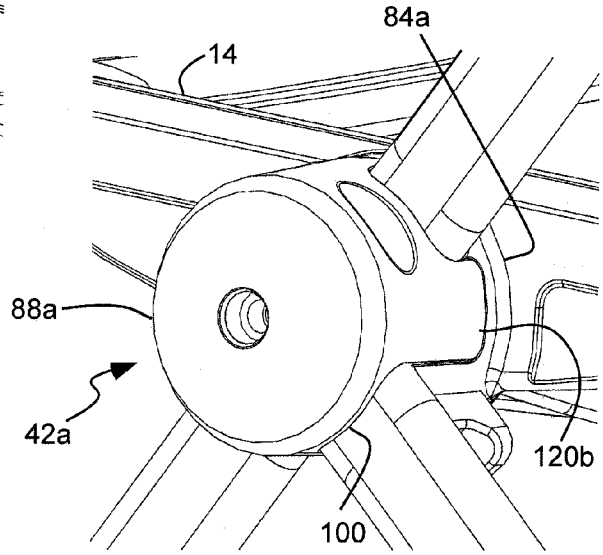
FIG. 5*h* is a detailed perspective view of the joint of FIG. 5*g* with the outer clamp added.
Figure 5I:
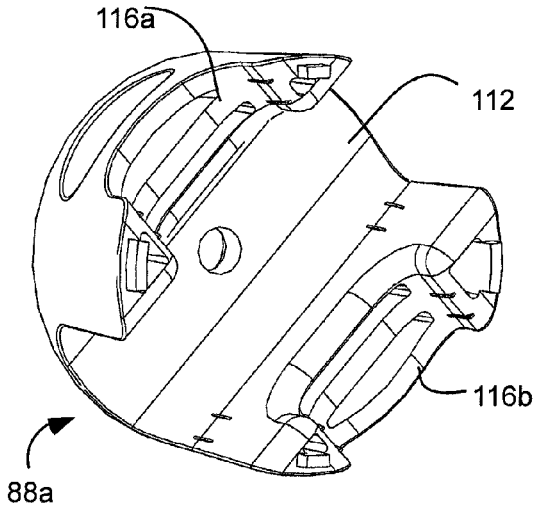
FIG. 5*i* is a detailed perspective view of the outer clamp of the joint of the chair of FIG. 1*a;*
Figure 5J:
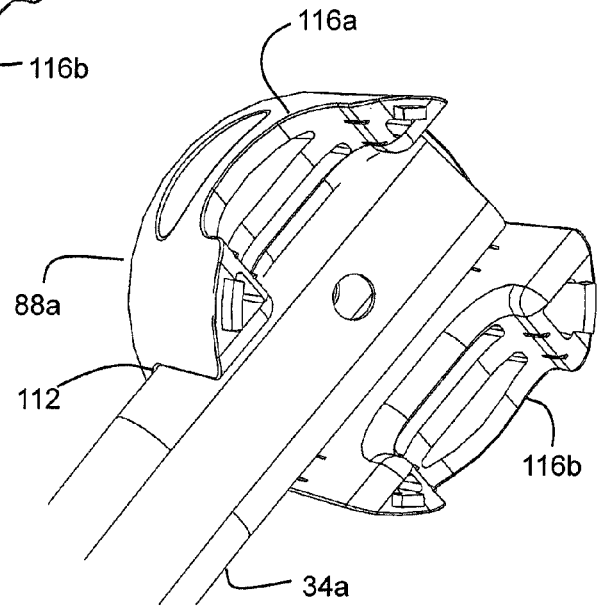
FIG. 5*j* is a detailed perspective view of the outer clamp of FIG. 5*i* with the rear leg added.
Figure 5K:
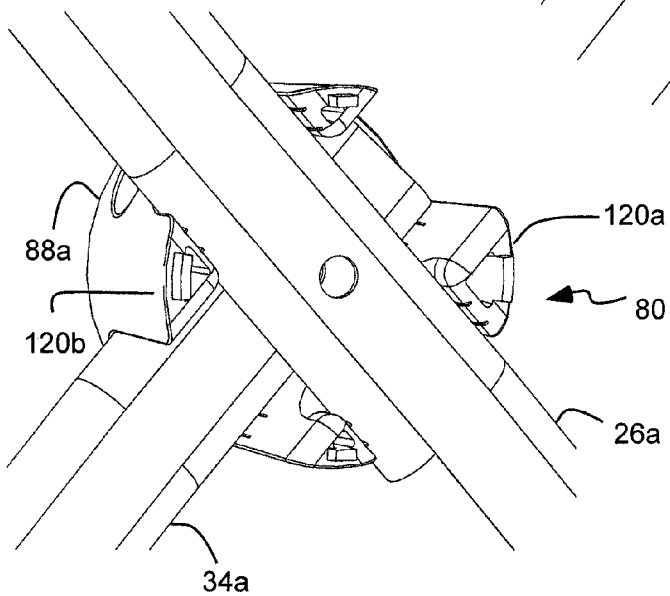
FIG. 5*k* is a detailed perspective view of the outer clamp of FIG. 5*j* with the front leg added.
Figure 6A:
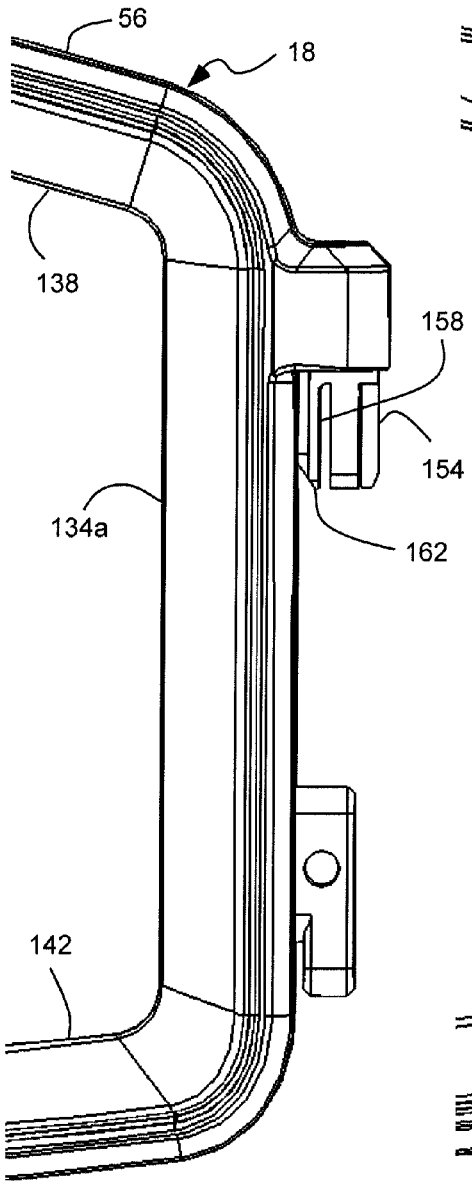
FIG. 6*a* is a partial front view of a backrest of the chair of FIG. 1*a;*
Figure 6B:
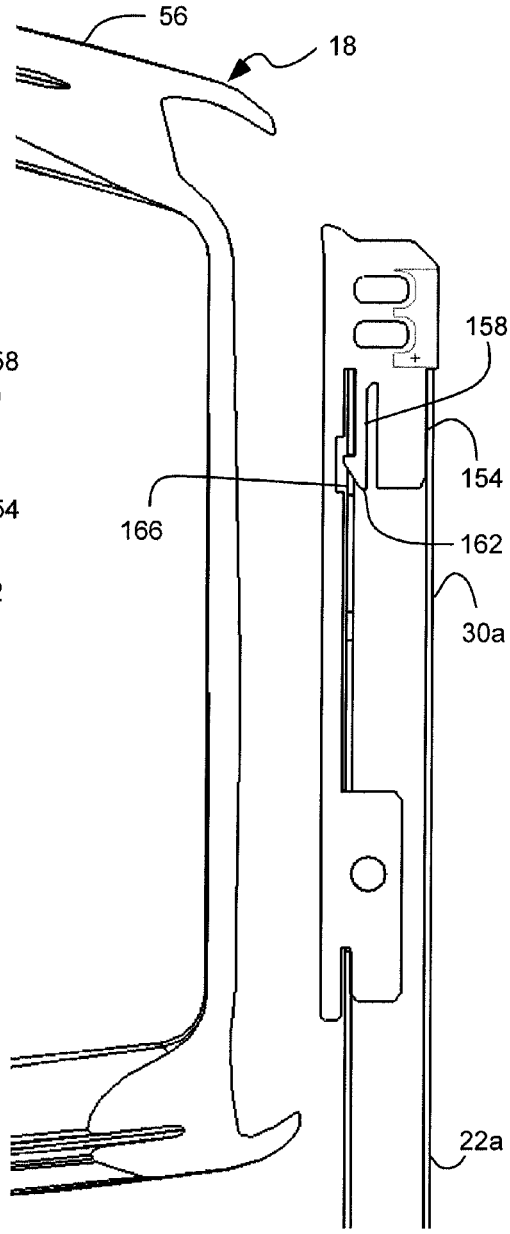
FIG. 6*b* is a cross-sectional side view of the backrest of the chair of FIG. 1*a;*
Figure 6C:
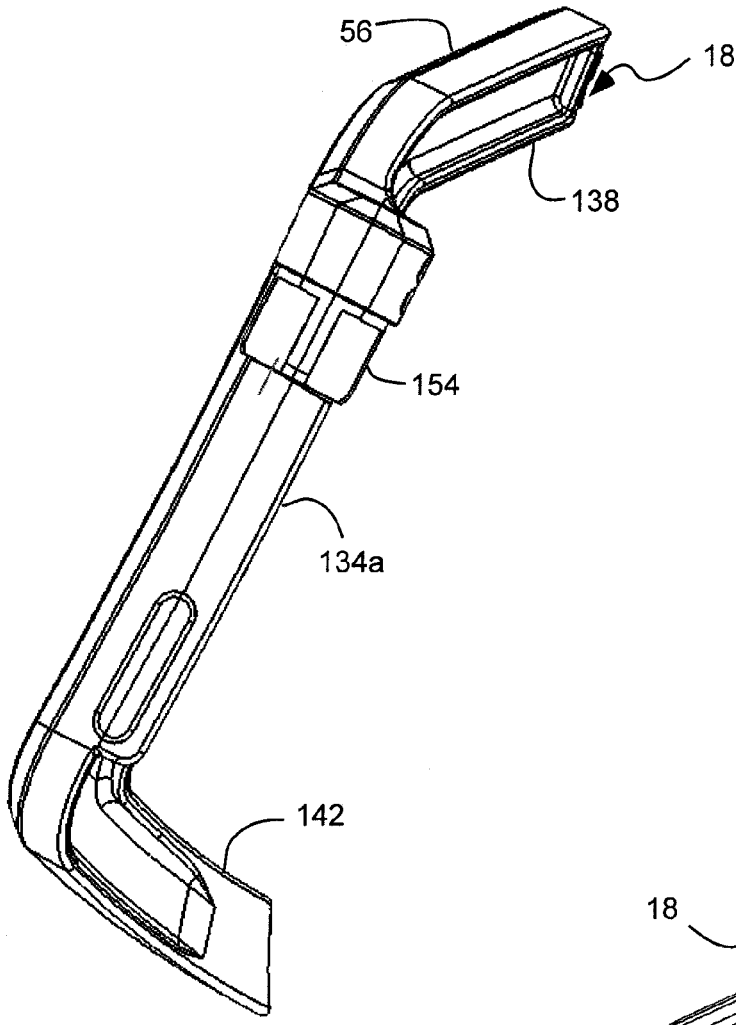
FIG. 6*c* is a side view of the backrest of FIG. 6*a;*
Figure 6D:
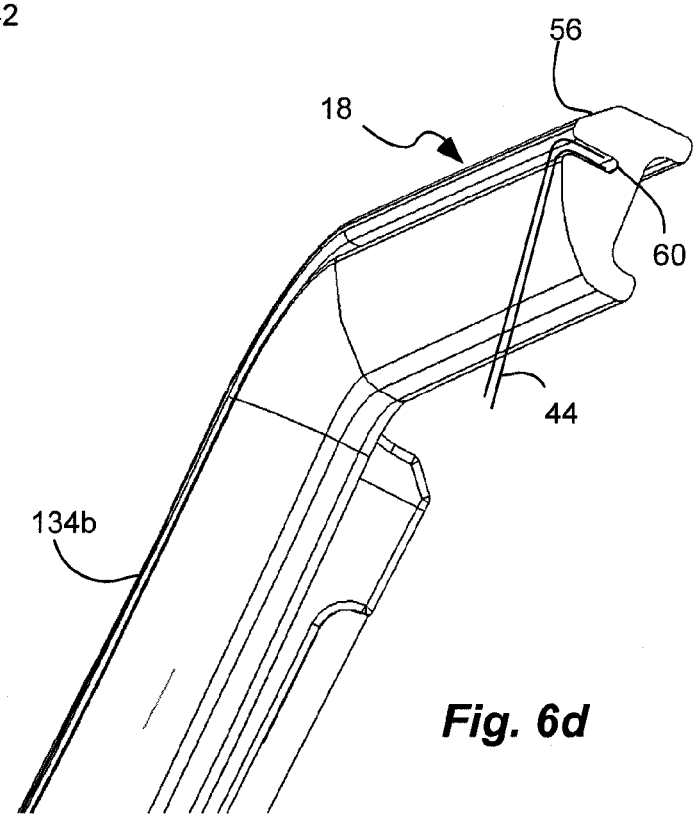
FIG. 6*d* is a partial cross-sectional view of the backrest of FIG. 6*a;*
Figure 7A:
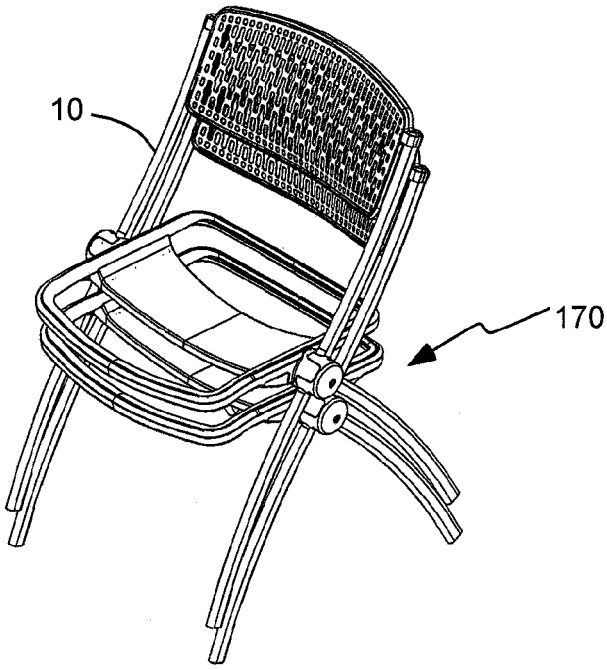
FIG. 7*a* is a perspective view of a stacking chair system in accordance with the present invention.
Figure 7B:
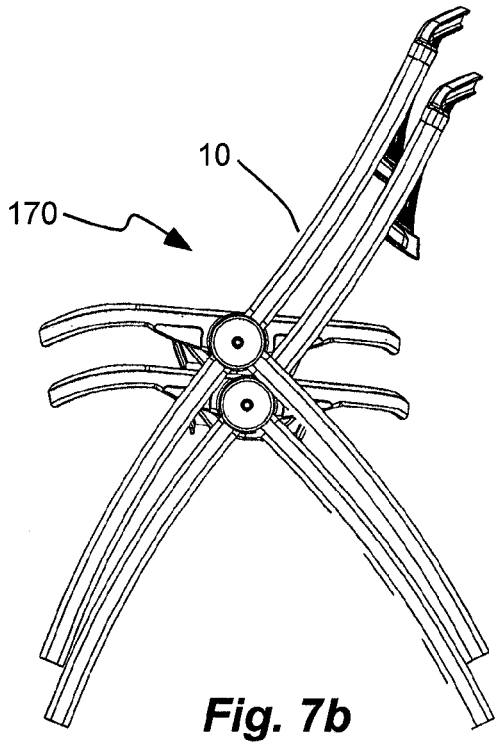
FIG. 7*b* is a side view of the stacking chair system of FIG. 7*a;*
Figure 7C:
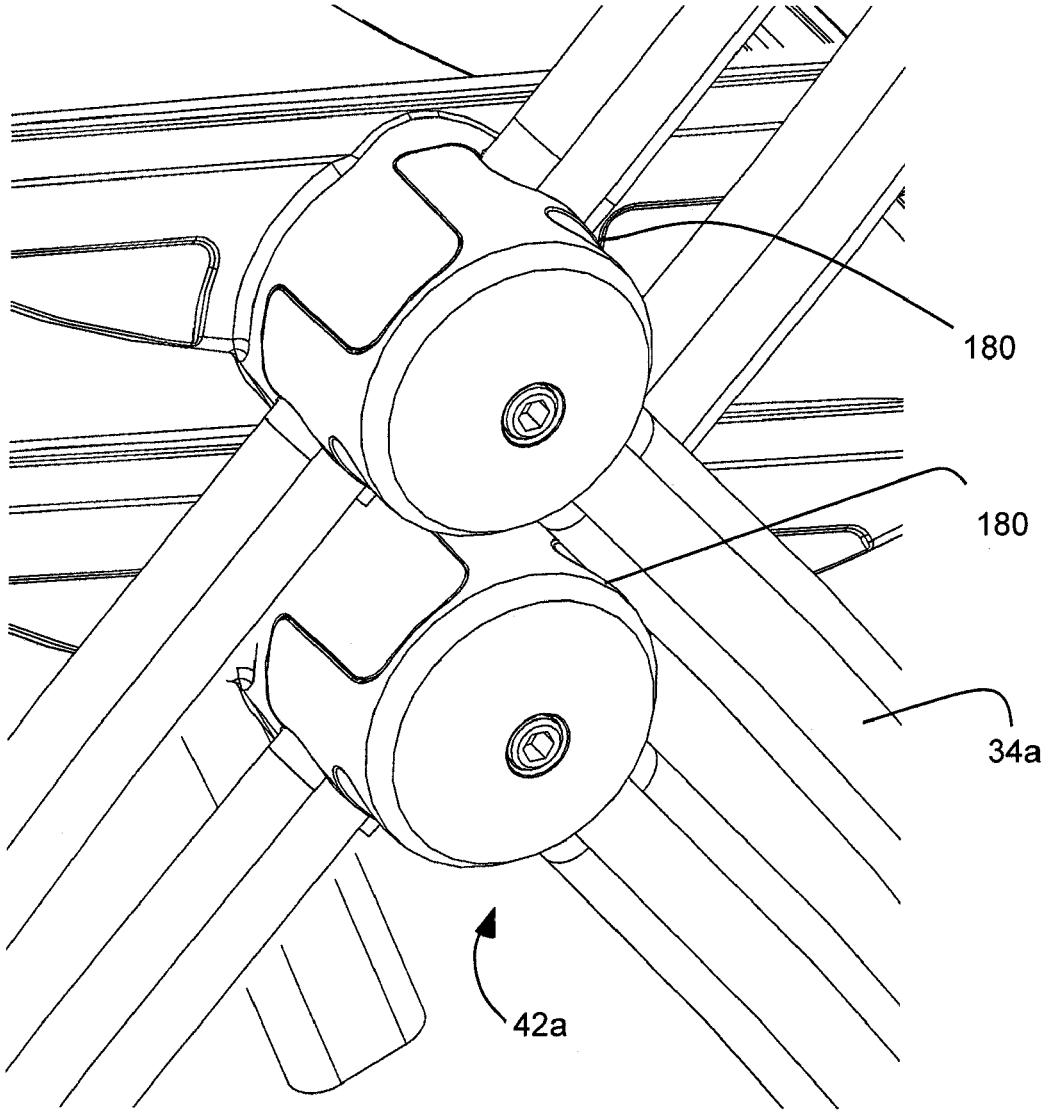
FIG. 7*c* is a partial perspective view of the stacking chair system of FIG. 7*a;*
Figure 7D:
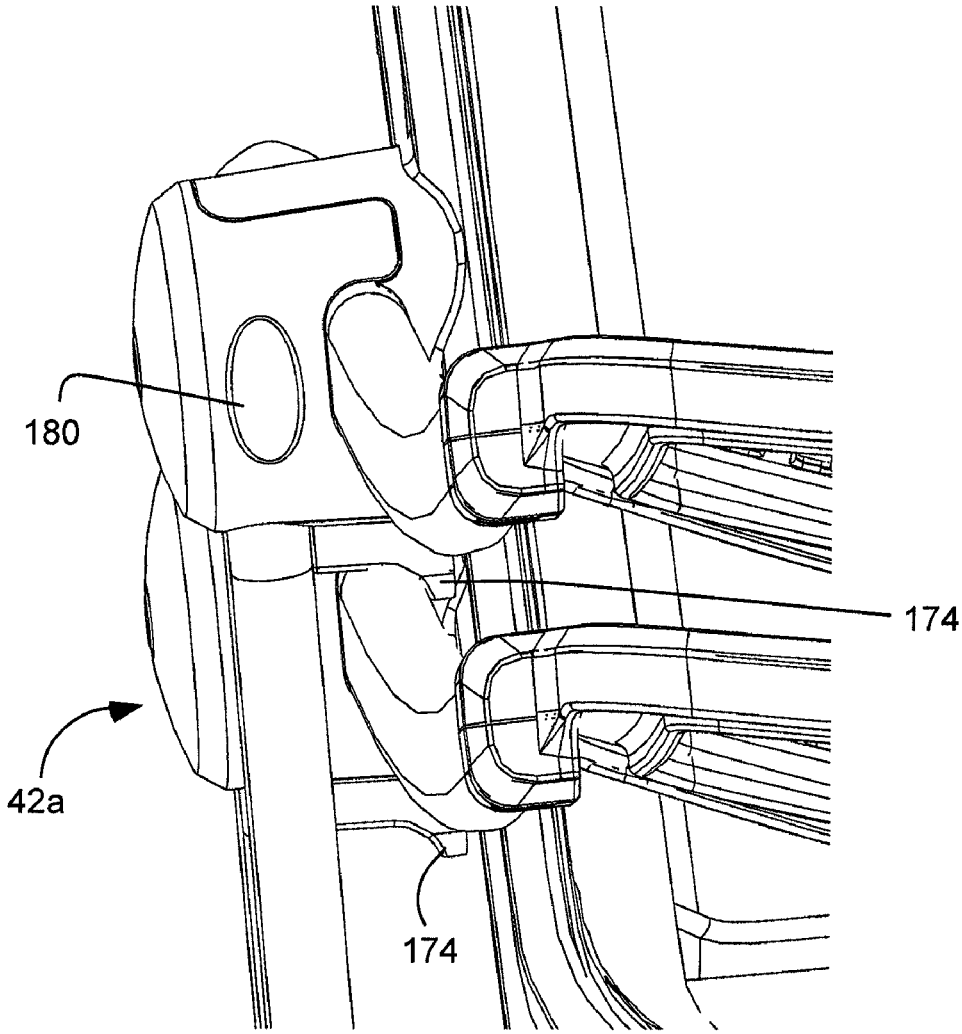
FIG. 7*d* is a partial perspective view of the stacking chair system of FIG. 7*a;*

The chair 10 can include a frame with opposite frame sides 22*a* and 22*b* that carry the seat 14 and backrest 18 therebetween. The frame sides can each include an elongated member defining a front leg 26*a* and 26*b* with a lower portion thereof, and a backrest support 30*a* and 30*b* with an upper portion thereof. Thus, the backrest support 30*a* and 30*b* is essentially an extension of the front leg 26 and 26*b*. In addition, the opposite side frames can each include a rear leg 34*a* and 34*b*. Thus, the frame sides can each include a pair of tubes with one tube forming the front leg and backrest support and the other tube forming the rear leg (and armrest support in some embodiments). The frame sides 22*a* and 22*b* can be coupled together by the seat 14 and backrest 18, without any need for front or rear lower cross members that extend between the front and rear legs respectively nearer a lower end of the legs as in other chairs. Thus, the lower ends of the front and rear legs are free beyond their connection to the seat. The front and rear legs can be rigidly coupled together, and fixed in a spaced-apart relationship with respect to one another. The front and rear legs are inclined outwardly (forwardly and rearwardly) to facilitate stacking with another chair. The front legs (or elongated members) and the rear legs can be separate and discrete components joined together at joints 42*a* and 42*b*, as described in greater detail below. Thus, a respective front and rear leg are joined to the seat at the joint, and joined to the other front and rear leg by the seat. The front and rear legs, and the backrest support, can be formed of metal, such as steel or aluminum, and can be tubular for lighter weight. The cross-sectional shape of the members and chair legs can be elliptical for added strength. In addition, the members can be curvilinear and can have a gradual or shallow stretched s-shaped profile to facilitate stacking. The front and rear legs can have opposite, concave curvature so that they can nest or stack with legs of an adjacent chair. The chair 10 can have an unassembled, ready to assemble, and ready to ship configuration (FIGS. 9*a* and 9*b*); and an assembled, seating or ready for use configuration, as shown in FIGS. 1*a* and 1*b*. In the unassembled, ready to assemble and ready to ship configuration, the chair or its components can fit in a flat, knock-down box (300 in FIGS. 9*a* and 9*b*). In the assembled, seating or ready for use configuration, the chair rests on a support surface and a user can sit on the seat, and the chair can be stacked on another chair and stored in less space.

The seat 14 and the backrest 18 can each have a continuous sheet of flexible and elastic mesh (represented by 44) held taut across and substantially covering the seat and backrest. The terms "mesh" and "sheet of mesh" are used interchangeably herein to refer to a mesh material that is a continuous sheet in that it is essentially consistent in its composition of strands and intervening openings (although it may have a pattern therein) and essentially covers the entirety of the seat and/or backrest (as opposed to individual strands or discrete straps with larger openings therebetween); and that is flexible and elastic in that it readily deflects under the weight of a user and returns to its previous position after unloading (as opposed to an embossed metal or rigid screen). A space can separate the seat and the backrest, and can define a gap between the mesh of the seat and the mesh of the backrest. The mesh material can include a polypropelene mesh fabric or the like. The mesh can be a woven mesh or a knitted mesh. The mesh material can include 70% elastomer monofilament with a 55 durometer and 30% polyester yarn. The elastomeric monofilament can be a polyester co-polymer (such as Hytrel by Dupont). The interwoven monofilaments can also be bonded together to resist unraveling, for example by using a coextruded monofilament with an outer layer having a lower melting point that melts in an oven to bond to adjacent monofilaments. Openings can be formed through the mesh between the strands. The openings, which may have different sizes based on the pattern of the weave, can have substantially the same size, dimension or width of the strands, or be on the same order. Other types of mesh or compositions of strands with less or more elastomer can be used. As stated above, the mesh can be woven or knitted.

Alternatively, the seat 14 and the backrest 18 can each have a continuous sheet of flexible and elastic patterned open texture plastic (represented by 46) held across and substantially covering the seat and backrest. The term "sheet of patterned open texture plastic" is used herein to refer to a plastic material that has a series or arrangement of openings across the sheet and that is continuous in that it is essentially consistent in its composition of structure and openings (although it may have a pattern therein) and essentially covers the entirety of the seat and/or backrest. In addition, the sheet of plastic is flexible and elastic in that it readily deflects under the weight of a user and returns to its previous position after unloading (as opposed to an embossed metal or rigid screen). The sheet of plastic and the material of the sheet of plastic can be selected so that the sheet of plastic can deflect or bend. In addition, the openings can be sized and patterned to facilitate deflection or bending, and to eliminate pressure points. The openings and the material between the openings can be substantially the same size, dimension or width, or on the same order. Alternatively, an opening can be elongated and serpentine to substantially traverse a width, depth or height of seat or backrest. Again, a space can separate the seat and the backrest, and can define a gap between the sheet of plastic of the seat and the sheet of plastic of the backrest. The sheet of plastic and the all-plastic hoop can be formed together, such as by injection molding, so that the seat and backrest are manufactured as a single piece or unit. The all-plastic hoop can be distinguished from the sheet of plastic as a thicker perimeter.

In either case, the sheet of mesh or the sheet of plastic can provide the sole or only support of the user's weight. Thus, each side of the sheet of mesh or the sheet of plastic can be free or open, without other materials or fillers, such as foam or cloth.

In one aspect, only the seat can include the mesh supported by a seat frame. In another aspect, only the backrest can include the mesh supported between the backrest supports of the frame sides or a backrest frame. In another aspect, both the seat and the backrest can include the mesh. Whether one of the seat or the backrest or both include mesh can depend on the needs of the user. In addition, the sheet of mesh 44 can be held taut across and substantially cover an opening in an all-plastic hoop 48 fixed between the frame sides. For example, the seat can include an all-plastic seat hoop 52 and the backrest can include an all-plastic backrest hoop 56. The resiliency in the seat and backrest can be suited to the user's preference. In one aspect, the mesh of the seat can be stretched 4.5 to 5%, while the mesh of the backrest can be stretched 2.7 to 3.2%. Thus the backrest can have greater deflection and a softer feel because the loading on the backrest is not as great as the seat. In addition, the mesh can have variable tension along a longitudinal direction (front to back for the seat or top to bottom for the backrest) to provide for great comfort. The degree of lateral tension of the mesh of the backrest can vary along the height or elevation of the backrest to create lumbar support at a desired location. The mesh suspended between the hoops can provide greater comfort than traditional solid plastic or solid metal chairs while maintaining stackability. Similarly, the mesh can have variable lateral (side-to -side) tension. The all-plastic hoops can be formed by injection molding plastic, and may be formed of, or can include, polypropylene or nylon or ABS. In one aspect, the hoops can be formed of nylon and the seat hoop 52 can weigh less than 4.5 lbs, the backrest hoop 56 can weigh less than 1.5 lbs, and together can weigh less than 6 lbs, to reduce the weight of the chair while providing sufficient strength. In another aspect, the hoops can be formed of nylon and the seat hoop can weigh less than 3 lbs, the backrest hoop can weigh less than 1 lbs, and together can weigh less than 4 lbs. In another aspect, the hoops can be formed of polypropylene and the seat hoop can weigh less than 3 lbs, the backrest hoop can weigh less than 1 lbs, and together can weigh less than 4 lbs. In another aspect, the hoops can be formed of polypropylene and the seat hoop can weigh less than 2.6 lbs, the backrest hoop can weigh less than 0.8 lbs, and together can weigh less than 3.4 lbs. The amount or weight of the plastic material of the all-plastic hoops is balanced to provide sufficient strength to the frame and the sheet of mesh or plastic, while also reducing the weight of the chair. Such a configuration as described above can support a static load of at least 1250 lbs. In another aspect, it is believed that sufficient strength can be provided by a seat hoop with a weight as low as 1.25 lbs, a backrest hoop with a weight as low as 0.5 lbs, and a combined weight as low as 1.75. The all-plastic hoops are all-plastic in that they do not have any internal or external metal reinforcement members, although the plastic of the hoops can have fillers such as glass fibers. Thus, the seat and/or backrest hoops support both the mesh and the frame, reducing the number of parts and cost of the chair. The mesh 44 can be bonded, such as chemically or adhesively, in a channel 60 in the hoops, such as by melting the material of the mesh and the hoops together, or by chemical reaction, or with adhesive, or the like. Thus, the sheet of mesh can be attached to the hoop without mechanical fasteners, such as staples. (The mesh is represented by 44. Most of the mesh has been removed from the figures for clarity of the chair, seat, backrest and hoops. But the mesh extends across the entire opening of the hoops 48.)

The mesh 44 of the seat 14 and backrest 18 held taut in the hoops provide the comfort of an upholstered comfort in a non-upholstered stacking chair; while the hoops 48 can provide the sole, or only, structural support between the frame sides without front and rear lower cross members, or at least above the bottom thereof, or above front and rear lower cross members if so provided. As described above, the hoops can provide the support for both the mesh and the frame sides of the stacking chair. The all-plastic hoop 56 of the backrest provides the sole structural support between the backrest supports 30*a* and 30*b* of the frame sides 22*a* and 22*b*. Similarly, the all-plastic hoop 52 of the seat provides the sole structural support between the frame sides 22*a* and 22*b* at a middle of the chair or frame sides. Together, the all-plastic hoops 52 and 56 of the seat and backrest provide the sole structural support between the frame sides 22*a* and 22*b*. The hoops can be directly coupled to the frame sides, without intervening support members. The seat hoop 52 can be coupled to the frame sides, or front and rear legs, by a mechanical fastener such as a bolt. The backrest hoop 56 can couple to the backrest supports as described below. The hoops can be injection molded nylon with a total weight of less than 4 lbs to provide both light weight for ease of stacking and moving the chairs, and strength to support the taut mesh across the opening and support the frame sides.

The seat 14 and/or seat hoop 52 can be sized and shaped for both comfort and structural support. The seat hoop 52 can have opposite, parallel, substantially straight, hoop sides 64*a* and 64*b* coupled to the frame sides. A front 68 extends between the hoop sides and the front and/or front ends of the frame sides can arc downward (with respect to the chair in the unfolded seating position), or form an arc. The sheet of mesh 44 held taut between the seat hoop forms a longitudinal convex arc (represented at 72) at the front defining a leg relief near the front of the hoop of the seat. The mesh arc 72 or thigh support can have a broad downward curvature to provide comfort to the user's thighs when seated. The seat hoop 52 can have a substantially square shape with rounded corners. The front 68 of the seat hoop 52 can curve forwardly out of the square shape and downwardly out of the plane of the square.

An upper surface 74, or majority thereof, of the seat is oriented at an incline with respect to horizontal. The seat can be inclined between 3-7 degrees, or approximately 5 degrees, with respect to horizontal. The incline of the surface of the seat in combination with the deflection of the mesh form a more comfortable seating surface. The width $w_s$ of the seat and/or seat hoop at a perimeter of the hoop is equal to or greater than 17 inches. In another aspect, the width of the seat and/or seat hoop at a perimeter of the hoop is equal to or greater than 17.5 inches. The width in combination with the mesh forms a more comfortable seating surface.

The seat hoop 52 can also include a rigid plastic seat-support bar 76 laterally traversing the seat hoop to provide support to the seat hoop and frame sides. As a user sits on the mesh 44 of the seat 14, the mesh pulls inwardly on the seat hoop 52, and thus the frame sides 22*a* and 22*b*; which is resisted by the seat-support bar 76. The bar has an arcuate shape that curves downwardly from the sides to the center and into which the mesh of the seat can deflect when a user sits on the seat. The bar 76 can have a depth (front to back) of approximately ⅓ to ½ the depth of the seat. In addition, a distance from a top of the hoop of the seat to a lowermost top of the seat-support bar is greater than 2 inches to allow the mesh of the seat to deflect downwardly under the weight of a user. The bar 76 can be formed with the hoop 52.

Referring to FIGS. 2*a*-5*j*, the frame sides 22*a* and 22*b*, or front and rear legs 26*a*, 26*b*, 34*a* and 34*b*, can be coupled to the seat 14, or the all-plastic seat hoop 52, at joints 42*a* and 42*b* disposed on opposite sides of the chair. At each joint, one of the legs, such as the rear leg 34*a*, can be outside of the other leg, such as the front leg 26*a*, with respect to the seat 14 or seat hoop 52. In addition, at each joint, the legs overlap at an overlap 80 (FIGS. 5*b* and 5*g*), such as with the rear leg 34*a* overlapping the front leg 26*a*. The joint 42*a* couples the legs 26*a* and 34*a* to the seat 14 or seat hoop 52 at the overlap. The joints 42*a* and 42*b* include an inner clamps 84*a* and 84*b* coupled to the seat 14 or seat hoop 52, and an outer clamps 88*a* and 88*b* coupled to the inner clamps 84*a* and 84*b*, with the front legs 26*a* and 26*b* and the rear legs 34*a* and 34*b* clamped between the inner and outer clamps at the overlap. The inner clamps 84*a* and 84*b* can be integrally formed with the seat as a single integral, monolithic member of continuous material, such as plastic. In addition, the inner clamps 84*a* and 84*b* can be formed with a pair of lobes 92*a* and 92*b* (FIG. 2*a*) that can extend downwardly from lateral sides of the seat hoop 52. The lobes can be formed by plastic along with the chair hoop and inner clamps. The outer clamps 88*a* and 88*b* can be formed of metal for strength.

Figure 8A:
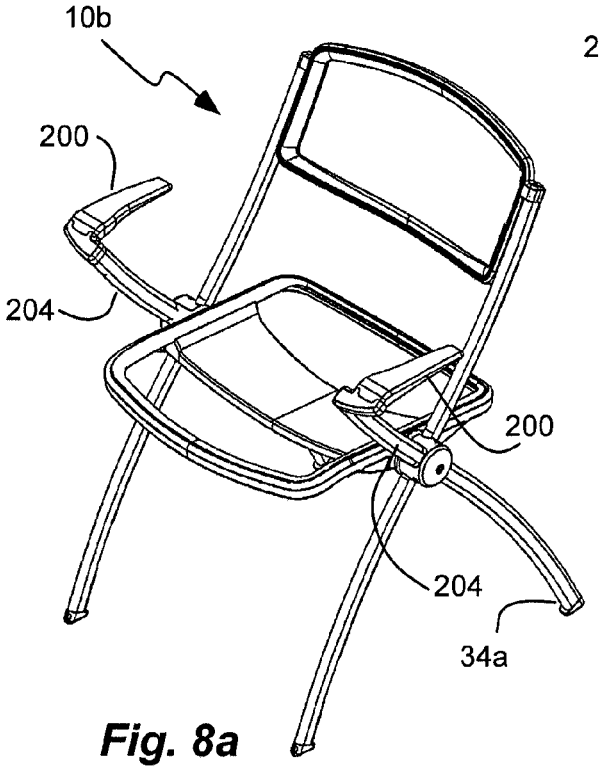
FIG. 8*a* is a perspective view of another stacking chair in accordance of another embodiment of the present invention.
Figure 8C:
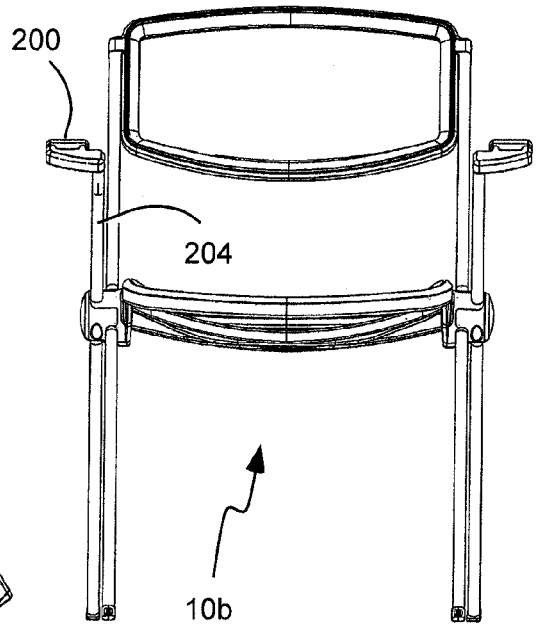
FIG. 8*c* is a front view of the chair of FIG. 8*a;*
Figure 8D:
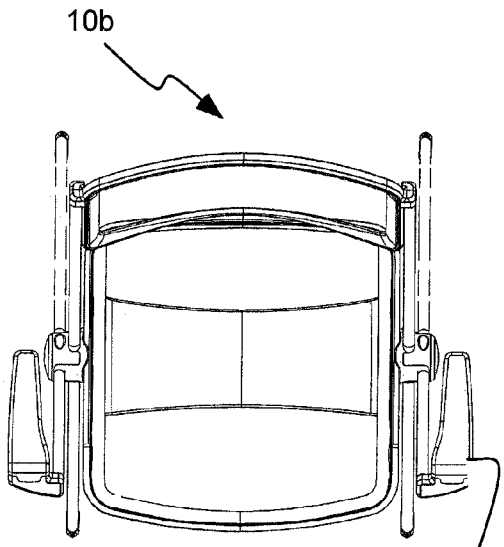
FIG. 8*d* is a top view of the chair of FIG. 8*a;*
Figure 8B:
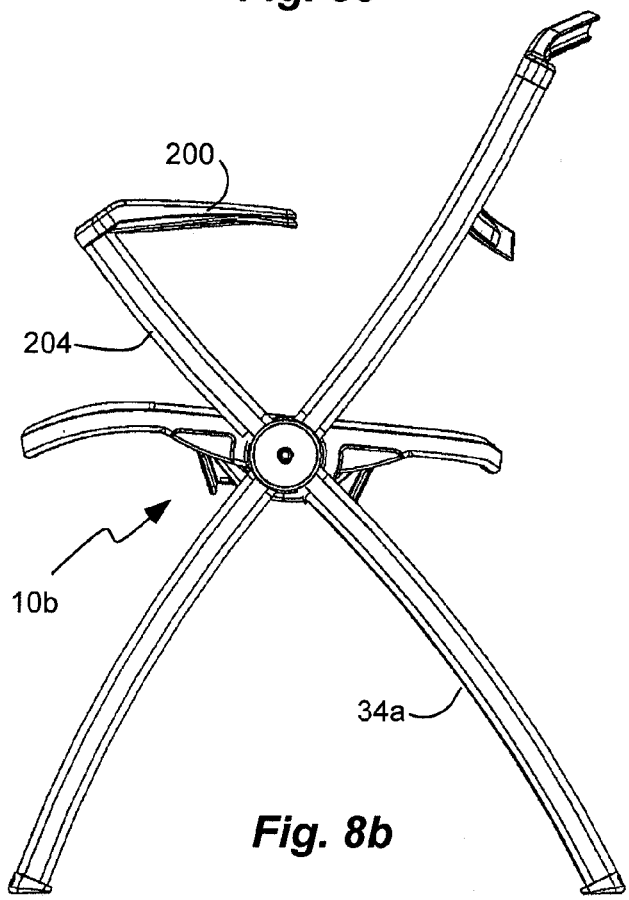
FIG. 8*b* is a side view of the chair of FIG. 8*a;*
Figure 8E:
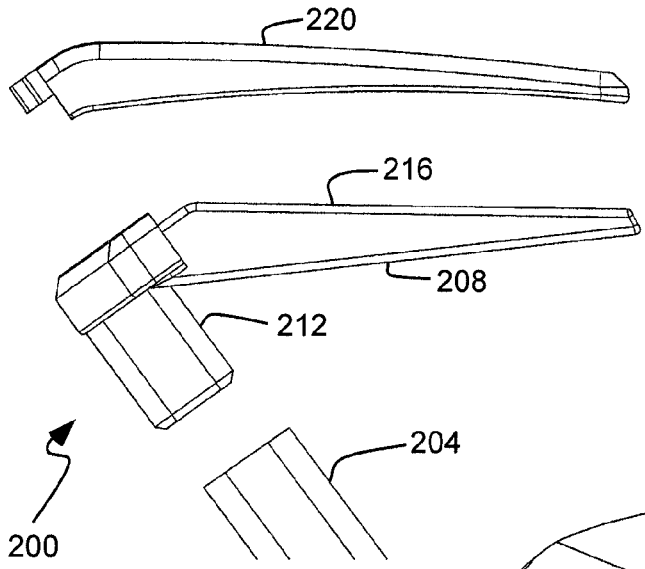
FIGS. 8*e-g* are partial exploded perspective views of an armrest of the chair of FIG. 8*a;*
Figure 8F:
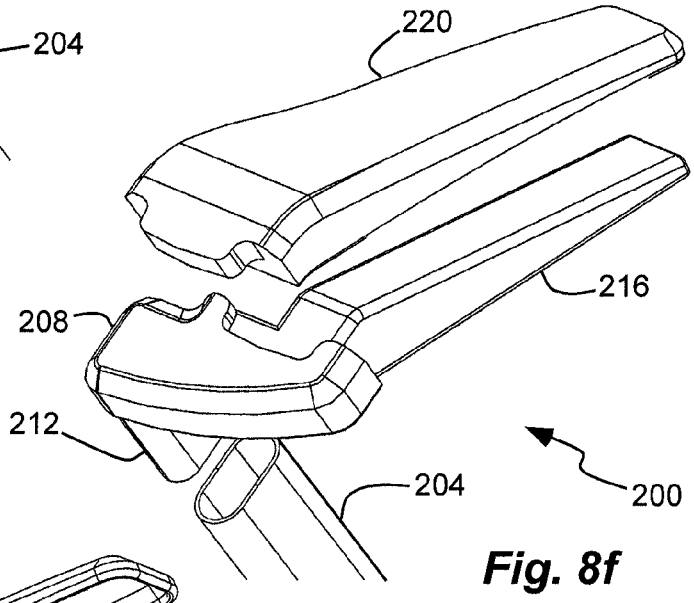
Figure 8G:
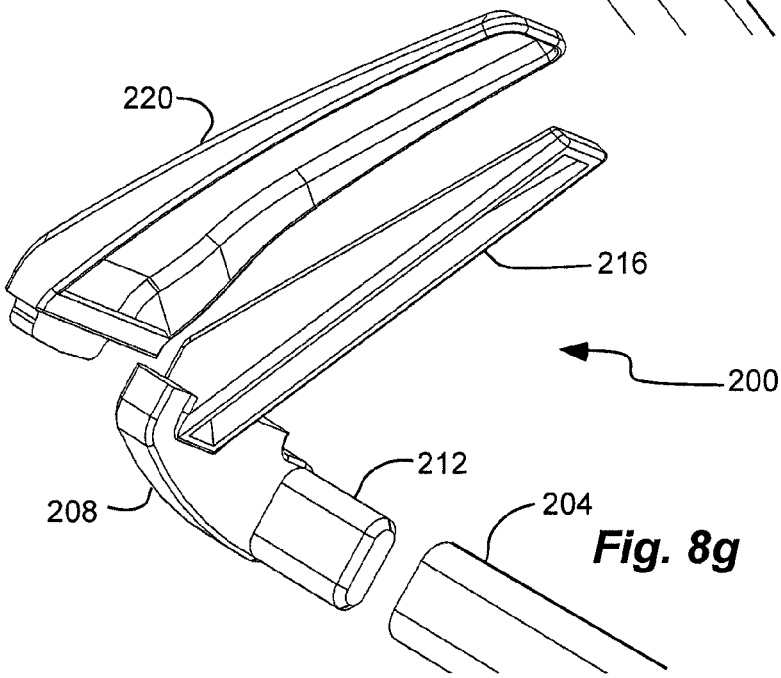

Each of the inner and outer clamps 84*a* and 84*b* can have inner and outer overlapping bores 96 and 100 (FIG. 4) formed between the inner and outer clamps. The bores 96 and 100 receive the front and rear legs, and can have cross-sectional shapes to match the cross-sectional shapes of the legs, such as oval. The non-circular shape of the bores and the legs help resist twisting of the legs within the bores. For example, the front leg 26*a* can be disposed in the inner bore 96, while the rear leg 34*a* is disposed in the outer bore 100. The inner and outer bores can be oriented transverse to one another, like the legs. The inner bore 96 can extend through the joint or inner and outer clamps with the front leg 26*a* or elongated member (with front leg 26*a* backrest support 30*a*) extending therethrough. The outer bore 100 can be capped or enclosed at the upper end with the rear leg extending into the bore and to the cap, but with the cap covering the upper end of the rear leg (see 102 in FIG. 1*b*). Alternatively, the rear leg can extend through the outer bore to an arm rest as described below and shown in FIG. 8*a*.

The inner and outer bores 96 and 100 can be formed by channels in the inner and outer clamps. The channels can be formed between posts of the inner and outer clamps which extend towards one another. For example, an inner channel 104 can be formed between inner posts 108*a* and 108*b* of the inner clamp 84*a*. Likewise, an outer channel 112 can be formed between outer posts 116*a* and 116*b* of the outer clamp 88*a*. The channel 104 and posts 108*a* and 108*b* of the inner clamp 84*a* are offset or transverse with respect to the channel 112 and posts 116*a* and 166*b* of the outer clamp 88*a* when the clamps are combined at the joint. Thus, the inner bore 96 can be formed between the inner channel 104 of the inner clamp 84*a* and the outer posts 116*a* and 116*b* of the outer clamp 88*a*. Similarly, the outer bore 100 can be formed between the outer channel 112 of the outer clamp 88*a* and the inner posts 108*a* and 108*b* of the inner clamp 84*a*. The tops of the posts can also have a channel formed therein that aligns with the channel in the opposing clamp to form the bores. A channel formed in the outer posts 116*b* of the outer clamp 84*b* aligns with the inner channel 104 of the inner clamp to form the inner bore. Similarly, a channel formed in the inner posts 108*a* and 108*b* of the inner clamp aligns with the outer channel 112 of the outer clamp 88*a* to form the outer bore 100.

The posts 116*a* and 116*b* of the outer clamp 88*a* are offset with respect to the posts 108*a* and 108*b* of the inner clamp 84*a*. In addition, one or more fingers on the inner or outer clamps extend towards the other, and are disposed between the front and rear legs. For example, a pair of fingers 120*a* and 120*b* is formed on the outer clamp 88*a* and extends towards the inner clamp 84*a*, with each disposed between the front and rear legs 26*a* and 34*a* in the front and rear directions. The fingers 120*a* and 120*b* are positioned to keep the legs 26*a* and 34*a* separated when a force, such as a seated person, is placed upon the seat, thus causing the legs to have a scissor effect at the fingers 120*a* and 120*b*. Furthermore, other fingers 122*a* and 122*b* can also be disposed between the legs in an up and down direction. The fingers and the outer clamp can be formed of a hard, rigid material, such as cast metal, to maintain the position of the legs even under loading. Thus, the joint or clamps have a plurality of intermeshing posts, fingers or both, on both of the inner and outer clamps which extend towards one another. The posts, fingers or both of the inner clamp intermesh with the posts, fingers or both of the outer clamp. Thus, the joint is formed by the inner and outer clamps, and the front and rear legs, and is substantially solid with substantially no exposed openings. The solid configuration of the joint resists snagging with clothing and resists pinching of the legs or fingers of a seated person.

The front and rear legs 26*a* and 34*a* can be disposed adjacent one another at the overlap without any intermediate structure between the front and rear legs at the overlap. In addition, the front and rear legs 26*a* and 34*a* can be clamped independently of one another between the inner and outer clamps so that the front and rear legs have a non-contacting relationship at the joint and between the inner and outer clamps. Thus, the bores overlap, but do not intersect, and the legs overlap, but do not contact or intersect one another. Separating the legs can reduce noise formed by legs in contact with one another and moving during loading and unloading or shifting in position. The channels or bores in the clamps or joints can also include ribs or fins 130 extending into the channels or bores causing an interference fit between the ribs and the front and rear legs. Thus, the legs are pinched between the ribs. Binding the legs can also reduce noise from legs moving with respect to the clamps.

Holes can extend through the outer clamp 88*a*, the rear leg 34*a*, the front leg 26*a* and the inner clamp 84*a* which align to form a single aligned hole through the joint. A single mechanical fastener, such as a bolt 126, can extending through holes in the outer clamp, the front and rear legs, and the inner clamp at the joint to hold the clamps together, and to hold the legs to the seat. Thus, only two mechanical fasteners or bolts, one for each joint, secure the legs and seat together. The bolt can mate with a nut on the inside of the inner clamp. The nut can be an insert in the mold such that the seat is molded around the nut. The bolt can extend inwardly beyond the seat hoop 52 to receive accessories, such as a basket that hangs beneath the seat, etc.

Referring to FIGS. 1*a*, 1*b* and 6*a-d*, the backrest 18 and/or backrest hoop 56 can be sized and shaped for both comfort and structural support. The backrest hoop 56 can have opposite, parallel, substantially straight, hoop sides 134*a* and 134*b* coupled to the backrest supports 30*a* and 30*b* of the frame sides. A top 138 extends between the top ends of the hoop sides. The top can have an upward curvature. An arcuate bottom 142 extends between bottom ends of the hoop sides. The bottom arcs rearward with respect to the chair and to a greater degree than any arcing of the top in the rearward direction. The bottom of the backrest forms a deeper arc than a top of the backrest. The sheet of mesh 44 forms a lumbar support near the arcuate bottom of the hoop of the backrest. The sheet of mesh 44 stretched taut between the backrest hoop forms an upright convex arc (represented at 146) between the top and the bottom, and a lateral concave arc (represented at 150) between the hoop sides. The backrest hoop 56 can have a substantially square shape with rounded corners. The top 138 of the backrest hoop 56 can curve outwardly out of the square shape in the plane of the square, while the bottom 142 can curve outwardly out the plane of the square.

The all-plastic backrest hoop 56 can be directly coupled to the backrest supports 30*a* and 30*b* of the frame sides 22*a* and 22*b*. As described above, the backrest supports of the frame sides can have a tubular configuration with an open top end. The open top ends can be oriented orthogonal to the tube and can form a flat annular opening. The backrest hoop 56 has a pair of shoulders that extend from the hoop and over the open top ends of the backrest supports to cover the openings. In addition, the backrest hoop includes a pair of opposite side fingers 154 that extend over and into the open top end to provide support between the backrest supports and to cover the open top end. The shoulders and/or fingers can have a step with a larger upper portion covering the tube, or flat annular opening, and a narrower lower portion extending into the tube and abutting the inner surface of the tube. A snap lock is formed between the backrest hoop and the backrest supports. An elongate finger 158 extends from the backrest hoop and into the open top end of the backrest supports. A hook 162 is formed on the finger and extends into a hole 166 in the backrest support. The finger is flexible and an angled surface of the hook can cause the finger to flex or bend inwardly as the finger is inserted into the open top end. The finger is resilient to snap the hook into the hole, while an orthogonal surface of the hook abuts the hole, resisting removal of the finger and hook from the open top end. Additional tabs with enlarged heads and narrow necks can be formed on the backrest hoop to extend into key holes in the backrest supports.

Referring to FIGS. 7*a-d*, the chair 10 described above can be part of a stacking chair system, indicated generally at 170, comprising a plurality of stacking chairs. The chairs have an unstacked seating position, as shown in FIGS. 1-4, in which the chairs are configured for sitting upon, and a stacked position, as shown in FIGS. 7*a-d*, in which the chairs are stacked together. The joints 42*a* and 42*b* can be configured to facilitate the stacking of the chairs. The joints or the inner clamps 84*a* and 84*b* can include a tab or hook 174 (FIG. 7*d*) extending from the joint or inner clamp to engage a leg or a frame, such as the front leg 26*a* or upper portion of the elongated member, of a lower stacked chair. Thus, a channel is formed between the tab 174 and the rear leg that receives the front leg or upper portion of the elongated member of the lower chair to resist movement between the stacked chairs. The tab 174 can be integrally formed with the inner clamp 84*a* and chair hoop 52. In addition, a dimple 180 (FIG. 6*d*) can be formed in the joint or outer clamp 88*a* to receive a leg, such as the rear leg 34*a*, of an upper stacked chair. Similarly, the dimple resists movement between the stacked chairs. Therefore, the joints are configured to facilitate stacking.

Referring to FIGS. 8*a-e*, another chair 10*b* is shown that is similar to that described above, but further including armrests 200. An upper portion or extension 204 of the rear legs 34*a* and 34*b* can extend beyond the joint. The armrests 200 can be disposed on the upper portions. The armrests can include a brace 208 with a shaft 212 inserted into an open tubular end of the extension of the rear leg and an arm 216 extending therefrom. In addition, the armrests can include a cover 220 disposed over the arm. The arm 216 can be laterally off-set with respect to the shaft 212 so that the armrest is laterally off-set with respect to the extension of the rear leg to facilitate stacking. In addition, the arm can provide structural support for supporting the cover. A portion of the cover can be flush with a portion of the brace.

The chair can have feet that provide both a slip and scratch resistant surface, and a stacking aid. The feet for both the front and rear legs can be identical or universal; but with opposite orientations. Each foot has a bottom surface to abut a support surface in the seating position. In addition, each foot can have a channel for receiving an adjacent stacked leg in the stacked position. An insert portion of the foot can be inserted into an open bottom end of the tubular front and rear legs. The insert portion can be sized to be press fit into the legs. Alternatively, the chair legs can be provided with casters so that the chair can roll on a support surface.

The aspects of the chair described herein help provide an improved stacking chair; with decreased weight while retaining strength and comfort; while maintaining an affordable and manufacturable chair. In addition, the mesh stretched between plastic hoops provides comfort and reduces weight while maintaining strength and affordability.

Figure 9A:
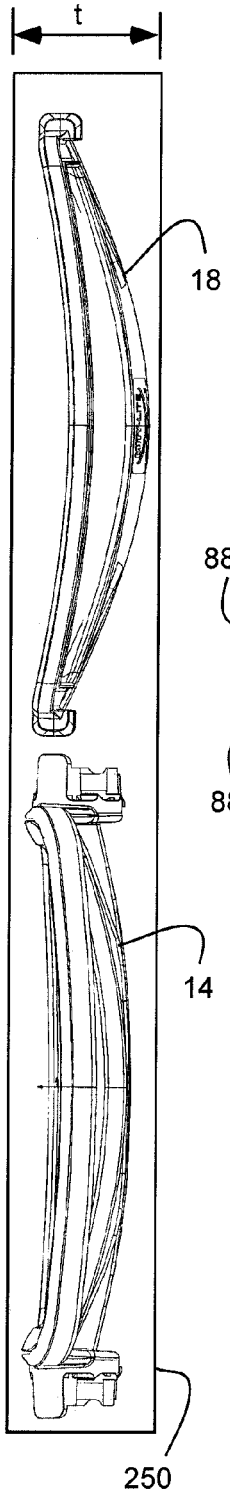
FIG. 9*a* is a side schematic view of a disassembled chair of FIG. 5*a* packaged in a box.
Figure 9B:
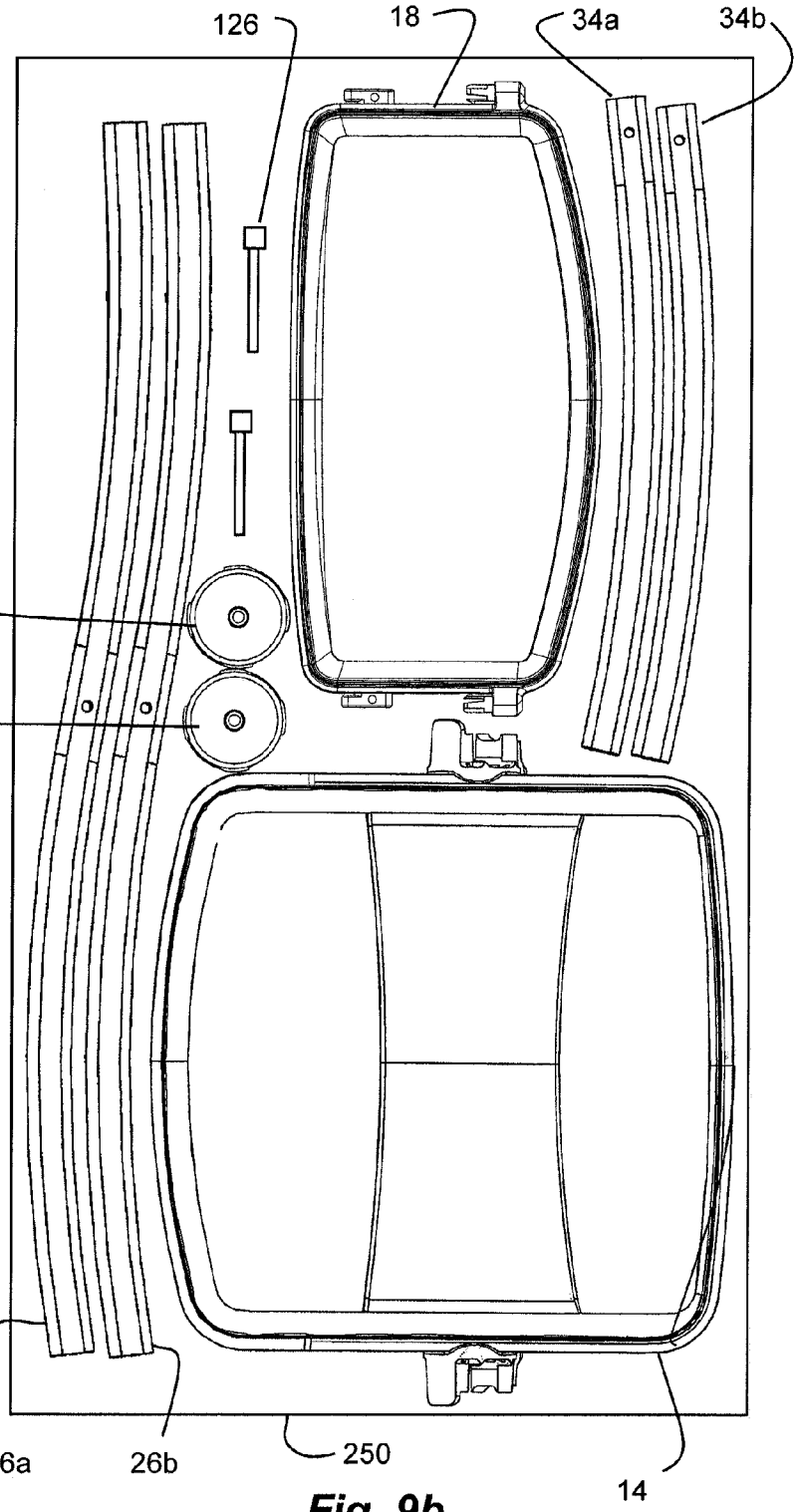
FIG. 9*b* is a front schematic view of the disassembled chair of FIG. 9*a* packaged in the box.
Figure 10A:
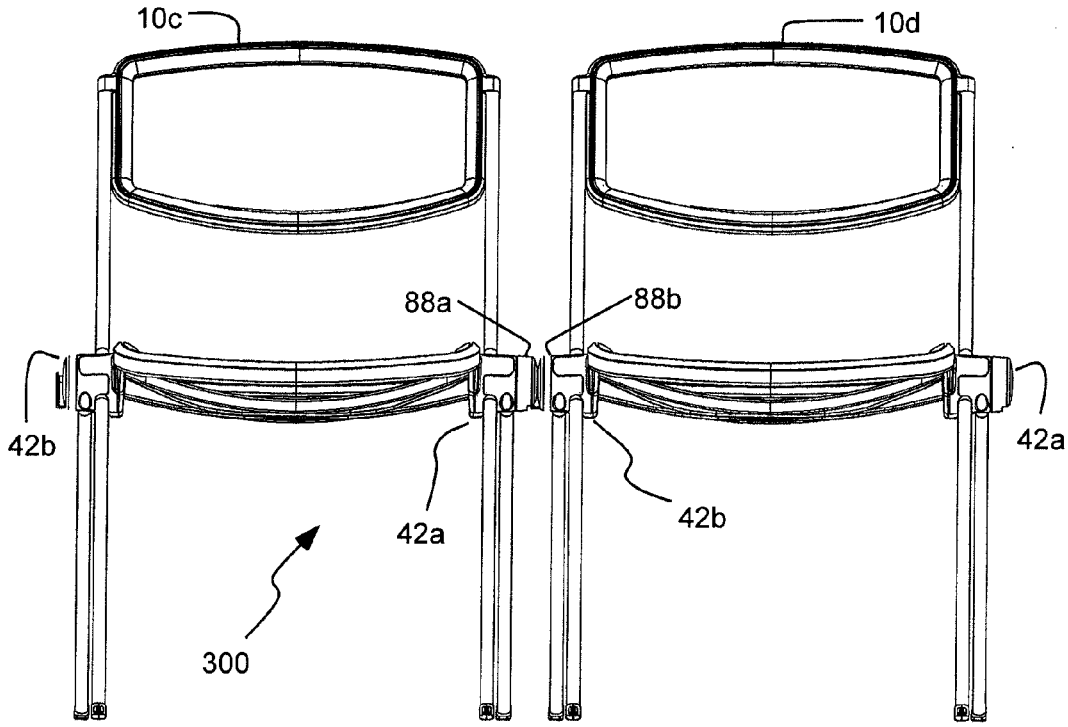
FIG. 10*a* is a front view of a pair of stacking chairs ganged together in a ganged chair system in accordance with an embodiment of the present invention and with mesh of the seat and backrest removed for clarity.
Figure 10B:
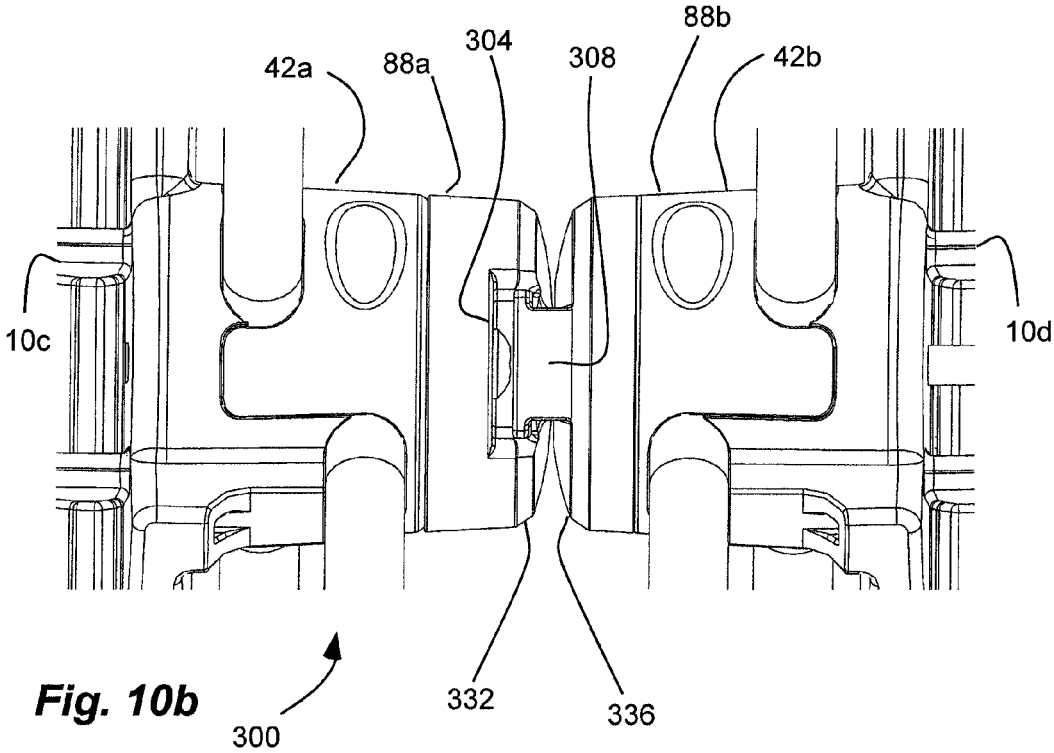
FIG. 10*b* is a partial bottom view of adjacent joints of the ganged chair system of FIG. 10*a;*
Figure 10C:
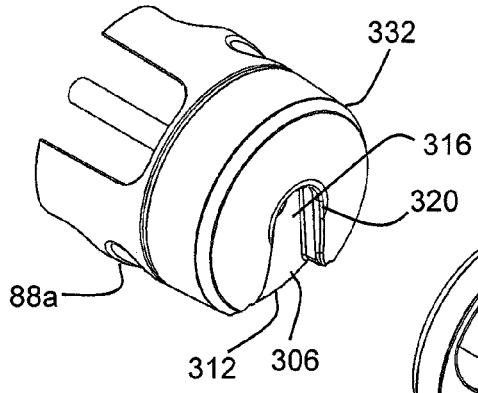
FIGS. 10*c* and *d* are perspective views of adjacent joints of the ganged chair system of FIG. 10*a;*
Figure 10C:
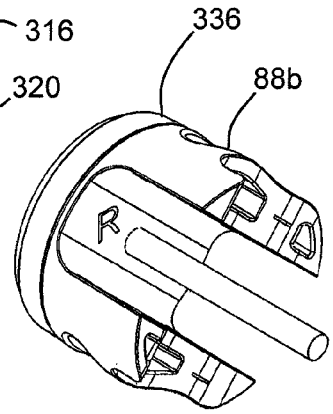
Figure 10D:
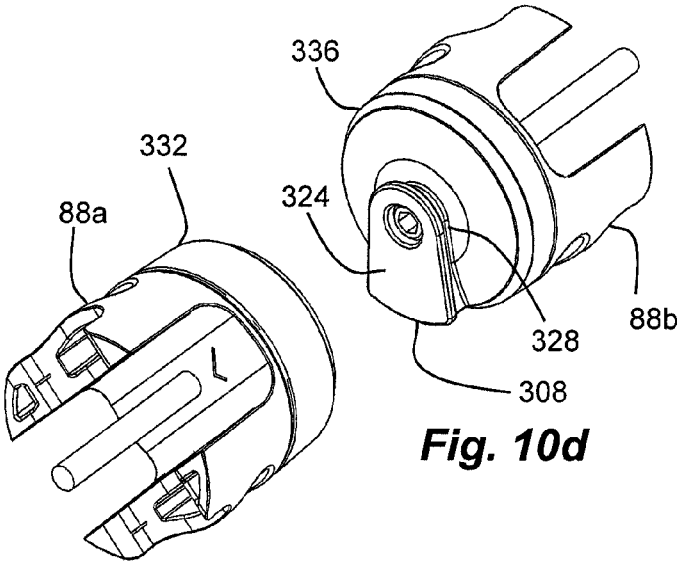
FIG. 10*e* is a top cross-sectional view of adjacent joints of the ganged chair system of FIG. 10*a;*
FIG. 10*f* is a side cross-sectional view of adjacent joints of the ganged chair system of FIG. 10*a;*
FIG. 10*g* is a side cross-sectional view of adjacent joints of the ganged chair system of FIG. 10*a;*
Figure 10E:
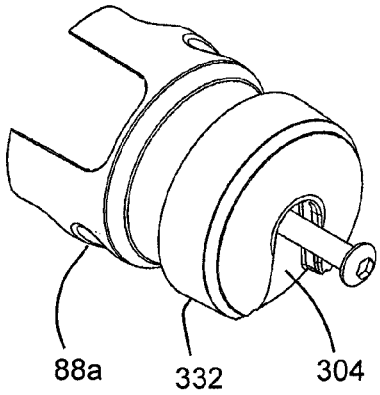
Figure 10E:
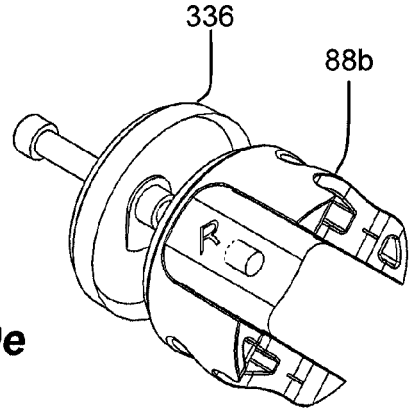
Figure 10F:
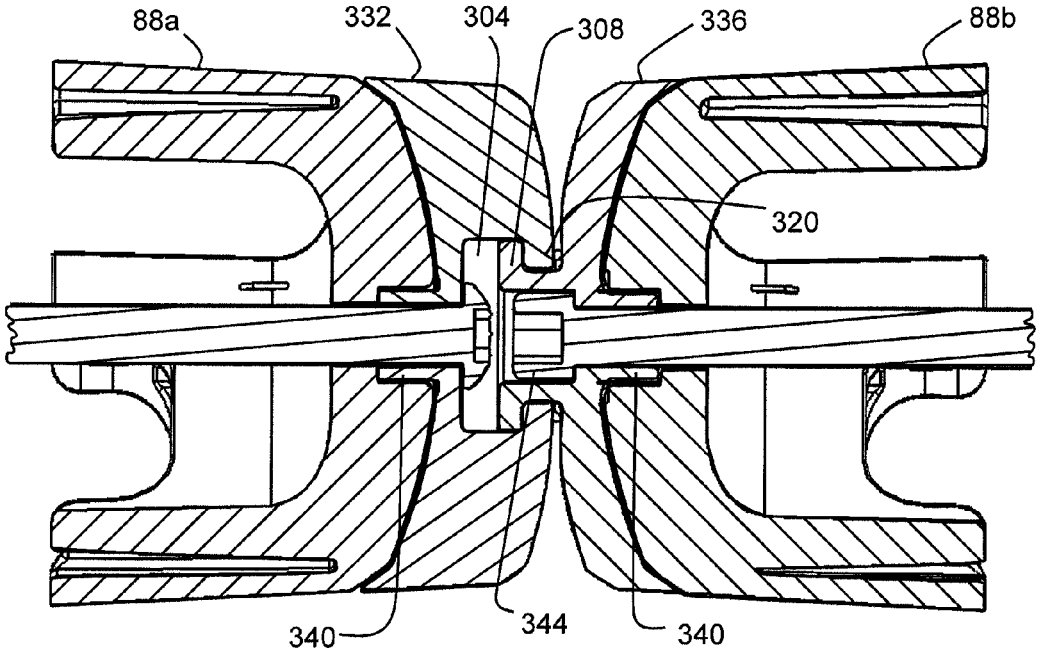
Figure 10G:
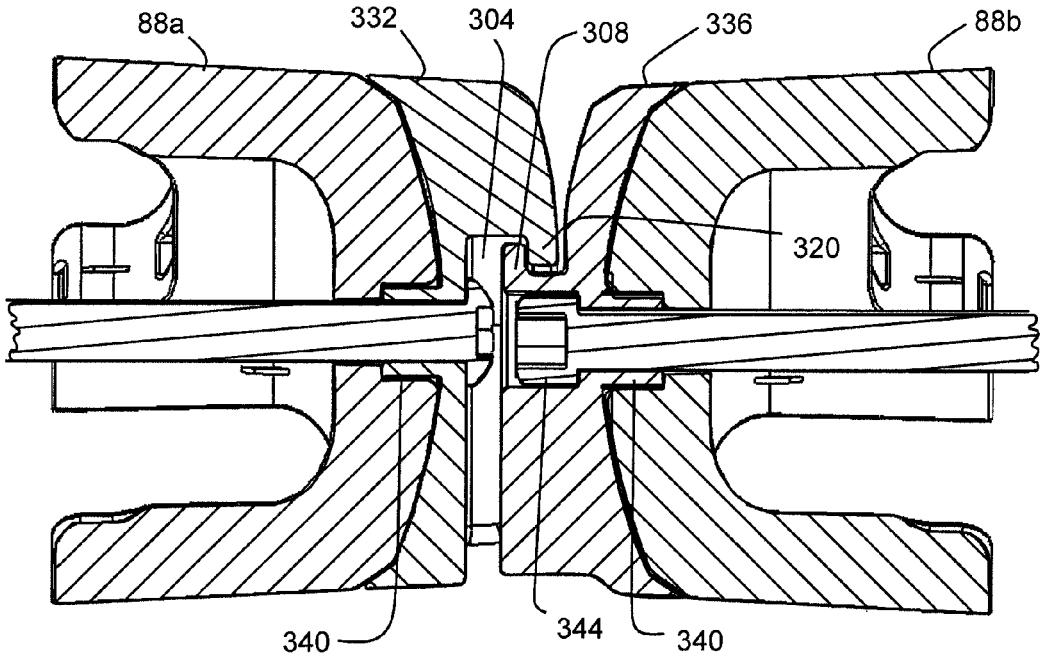

Referring to FIGS. 9*a* and 9*b*, the chair 10 or its components can be shipped in a flat, knock-down box 250 and can be ready to assemble (RTA). The components of the chair 10 include the seat 14, the backrest 18, the front legs (and backrest supports) 26*a* and 26*b*, the rear legs 34*a* and 34*b*, the outer clamps 88*a* and 88*b* of the joints, and a pair of bolts 126. All of the components can be provided separately in a box with a thickness t less than 4 inches. The thinness of the box allows for greater shipping efficiency. The chair 10 can be easily and quickly assembled by placing the legs in the joint and attaching an outer clamp of the joint and snap fitting the backrest. The front leg 26*a* can be placed in the channel of the inner clamp 84*a* of the seat 14; a rear leg 34*a* can be place over the front leg and in the outer channel of the outer clamp 88*a*; and a bolt 126 inserted through the holes. This process can be repeated for the other side of the chair. The backrest 18 can be snap fit into the backrest support of the front legs. Thus, the chair can be assembled without welding and without cross leg supports between the front legs or the rear legs.

Figure 11A:
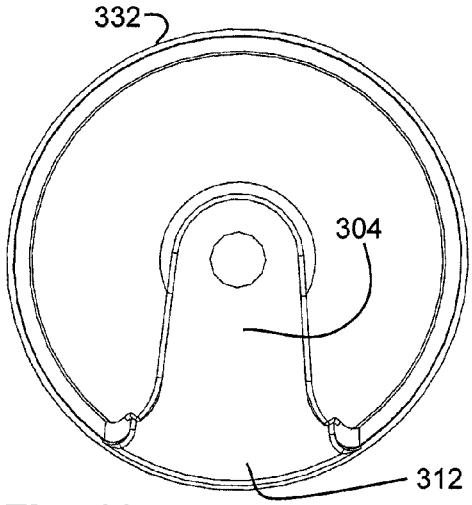
FIG. 11*a* is a front view of a notch cap of the ganging chair system of FIG. 10*a;*
Figure 11C:
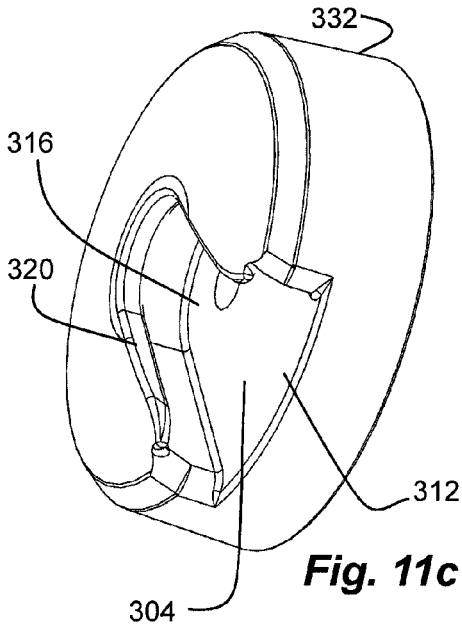
FIG. 11*c* is a perspective view of the notch cap of FIG. 11*a;*
Figure 11B:
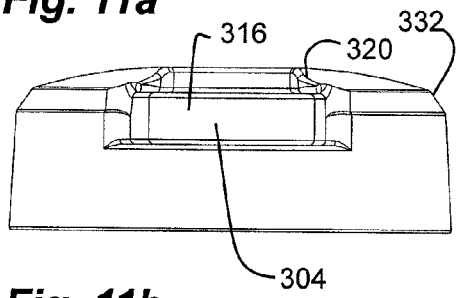
FIG. 11*b* is a bottom view of the notch cap of FIG. 11*a;*
Figure 12B:
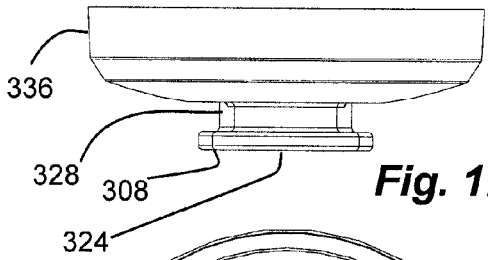
FIG. 12*b* is a top view of the tab cap of FIG. 12*a*.
Figure 12C:
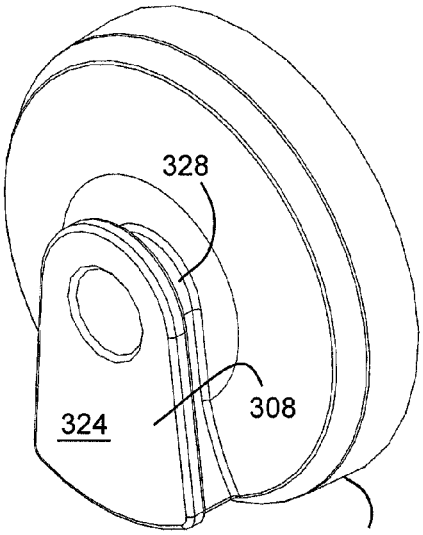
FIG. 12*c* is a perspective view of the tab cap of FIG. 12*a*.
Figure 12A:
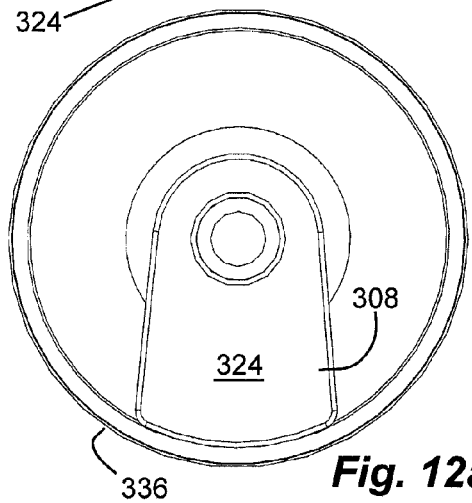
FIG. 12*a* is a front view of a tab cap of the ganging chair system of FIG. 10*a;*

Furthermore, referring to FIGS. 10*a-g*; FIGS. 11*a-c*; and FIGS. 12*a-c*, a ganged chair system 300 is shown in which the joints 42*a* and 42*b* of adjacent stacked chairs 10*c* and 10*d* can be configured to gang together. As described above, the front and rear legs overlapping each other at overlaps on each side of the seat with one of the front and rear legs outside of the other with respect to the seat. The joints 42*a* and 42*b* on each side of the seat coupling the legs to the seat, and include inner clamps coupled to opposite sides of the seat and outer clamps 88*a* and 88*b* coupled to the inner clamps on opposite sides of the seat with the legs clamped between the inner and outer clamps at the overlaps. A notch 304 can be disposed on one of the outer clamps 88*a* on one side of the seat, and a tab 308 can be disposed on the other of the outer clamps 88*b* on the other side of the seat. The notch 304 can face or open laterally outwardly and downwardly. Thus, the notch 304 can have an enlarged lower opening 312 that flares outwardly to facilitate insertion of the tab. The notch 304 can have an enlarged cavity 316 and reduced lip 320 to retain the tab in the notch. The tab 308 can mate and/or match the notch. The tab 308 can have an enlarged head 324 received in the enlarged cavity 316 and a narrower neck 328 connected to the head and extending out of the laterally outwardly facing opening of the notch. The notch is capable of receiving the tab of an adjacent chair to gang the chairs together at the adjacent joints. For example, an adjacent chair 10*c* with the notch 304 can be lifted and placed over the adjacent chair 10*d* with the tab 308 so that the tab is inserted into the notch. The chairs, or notch and tab, can be engaged and disengaged vertically, but resist laterally horizontal movement with respect to one another.

The notch and tab can be formed in and on the outer clamps. Alternatively, the outer clamps 88*a* and 88*b* can be as described above, and converted to have the notch and tab with a pair of different caps 332 and 336 each disposed on a different one of the outer clamps 88*a* and 88*b*. A notch cap 332 can be disposed on one outer clamp 88*a* and can include the notch 304 formed therein as described above. A tab cap 336 can be disposed on the other outer clamp 88*b* and can include the tab 308 formed therein as described above. The caps can have an interior cavity to receive a protrusion of the outer clamps. Thus, the outer clamps can nest within the caps. The caps can cover an outer face of the outer clamps. In addition, the caps can have interior columns or collars 340 (FIGS. 10*f* and 10*g*) which extend into and substantially fill a countersunk portion of the bolt holes of the outer clamps that normally receive the head of the bolt. A different pair of bolts can be provided to replace the bolts 126 that hold just the outer clamps. For example, the original bolts 126 can be replaced with different bolts that extend through an aperture in the caps, the outer clamps, the legs and the inner clamps. One of the bolts can have a long head 344 to provide support to the tab, and to the lip 320 of the notch. The other bolt can have a shallow head to stay out of the notch. Thus, the chairs described above can be easily converted from non-ganged chairs, to ganged chairs.

As described above, the seat and the backrest, or the hoops thereof, can be injection molded. The mesh can be secured between the mating hoops and the hoops attached. Alternatively, the mesh can be stretched between a pair of mating annular hoops, including a bottom (outer) hoop and a top (inner) hoop, as described in U.S. patent application Ser. Nos. 12/422,792; 12/422,801; 12/422,811; and 12/422,821; all filed Apr. 13, 2009. The hoops can match or mate together to sandwich the mesh material between the hoops. Similarly, the backrest can have a mesh material stretched between a pair of mating annular hoops, including a rear (outer) hoop and a forward (inner) hoop. The mesh can be stretched and then sandwiched and held between the hoops. For example, the mesh extends over an outer perimeter of the inner hoop and into an interface between the inner and outer hoops.

The pair of mating annular hoops of the seat can include mating annular notches. The mating notches can trap or sandwich the mesh material. The bottom hoop can include an annular notch formed around a top inner perimeter. The top hoop can be received within the annular notch. The top hoop can have an annular flange formed around a bottom inner perimeter and extending within an inner perimeter of the bottom hoop. In addition, the top hoop can have an upper surface that is curved and inclined inwardly for comfort. The mesh material can extend over the top or upper surface of the top hoop and between the hoops. The hoops can be attached by mechanical fasteners, such as screws or staples. In addition, the hoops can be joined by adhesive, sonic welding, etc.

The outer hoop of the seat includes lateral hooks extending inward with respect to the outer hoop and retaining the inner hoop from pulling inward under tension placed on the sheet of mesh. The lateral hooks can have a channel therein to receive the inner hoop. The lateral hooks allow tension to be placed from the inner hoop onto the outer hoop directly without placing sheer stress on fasteners.

Alternatively, the inner hoop of either the seat or the backrest can have a projection or flange, such as an annular flange, that extends into a channel or groove of the outer hoop, such as a mating annular channel, so that force applied to the inner hoop it transferred to the outer hoop through the mating projection and channel to reduce stress on any fasteners. Alternatively, the projection can be formed on the outer hoop and the channel can be formed on the inner hoop.

The hoops of the seat and/or backrest can include an integral snap lock fastening system. A plurality of forwardly projecting hooks is formed on either the inner or outer hoop, such as an interior projecting flange formed on the outer hoop. The hooks are received in a plurality of notches or apertures formed in the other hoop, such as inner hoop. The notches can be recessed in the inner hoop. The plurality of hooks in the plurality of notches retains the inner hoop on the outer hoop. The hooks can include opposite hook pairs facing in opposite directions. The hoop and the plurality of hooks can be formed as a single, integrally formed, plastic unit. Alternatively, the hoops can be attached by mechanical fasteners, such as screws or staples.

Another mesh folding chair in accordance with the present invention can have a seat that pivots with respect to the frame sides and back rest when the remainder of the chair is still in the unstacked seating position. Such a chair can be ganged together with other chairs to form a row of chairs for use in arenas and the like with the seats pivoted to a folded position to increase a passage between adjacent rows. The seat can be pivotally coupled to the inner clamps.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A stackable chair, comprising:

a) a seat and a backrest carried between opposite frame sides each with a backrest support, a front leg and a rear leg, the front and rear legs fixed in a spaced apart relationship from one another, the front and rear legs being inclined outwardly to facilitate stacking with another chair;

b) the seat having a continuous sheet of flexible and elastic mesh or patterned open texture plastic held across and substantially covering an opening in an all-plastic seat hoop;

c) a pair of plastic lobes formed as one piece with the seat hoop on opposite sides thereof and extending downwardly from the seat hoop;

d) the front and rear legs being coupled to the pair of plastic lobes; and e) a plastic seat-support bar formed as one piece with the pair of plastic lobes and laterally traversing the seat hoop.

2. A chair in accordance with claim 1, wherein the backrest has a continuous sheet of flexible and elastic mesh or patterned open texture plastic held across and substantially covering an opening in an all-plastic backrest hoop; and the all-plastic hoop of the backrest and the all-plastic hoop of the seat form the sole structural support between the frame sides.

3. A chair in accordance with claim 1, wherein the backrest has a continuous sheet of flexible and elastic mesh or patterned open texture plastic held across and substantially covering an opening in an all-plastic backrest hoop; and wherein the all-plastic hoop of the backrest forms the sole structural support between the backrest supports of the frame sides.

4. A chair in accordance with claim 1, wherein the all-plastic hoop of the seat forms the sole structural support between the frame sides at a middle of the frame sides.

5. A chair in accordance with claim 1, further comprising:

a space separating the seat and the backrest and defining a gap between the sheet of mesh or plastic of the seat and the sheet of mesh or plastic of the backrest.

6. A chair in accordance with claim 1, wherein a distance from a top of the hoop of the seat to a lowermost top of the seat-support bar is greater than 2 inches.

7. A chair in accordance with claim 1, wherein the sheet of mesh is bonded into the all-plastic hoop.

8. A chair in accordance with claim 1, wherein the sheet of mesh or plastic is attached to the all-plastic hoop without mechanical fasteners.

9. A chair in accordance with claim 1, wherein the sheet of mesh includes an elastomeric material.

10. A chair in accordance with claim 1, wherein the backrest has a continuous sheet of flexible and elastic mesh or patterned open texture plastic held across and substantially covering an opening in an all-plastic backrest hoop;

the backrest supports of the frame sides have a tubular configuration with an open top end; and the plastic hoop of the backrest has a pair of opposite side fingers that extend over and into the open top end to provide support between the backrest supports and to cover the open top end.

11. A chair in accordance with claim 10, further comprising snap lock between the hoop of the backrest and the backrest supports including:

an elongate finger extending from the hoop of the backrest into the open top end of the backrest supports; and a hook formed on the finger extending into a hole in the backrest support.

12. A chair in accordance with claim 1, wherein the seat further comprising:

a) opposite, parallel, substantially straight, hoop sides coupled to the frame sides; and b) a front extending between the hoop sides and arcing downward with respect to the chair; and c) the sheet of mesh or plastic forming a leg relief near the front of the hoop of the seat, the sheet of mesh or plastic forming:

a longitudinal convex arc at the front.

13. A chair in accordance with claim 1, wherein one of the front or rear legs is outside of another of the front or rear legs with respect to the seat and with one of the front or rear legs overlapping another of the front or rear legs at an overlap; and further comprising:

a) a joint coupling the legs to the seat including an inner clamp coupled to the seat and an outer clamp coupled to the inner clamp with the front leg and the rear leg clamped between the inner and outer clamps at the overlap; and b) a finger on one of the inner or outer clamps extending towards another of the inner or outer clamps and disposed between the front and rear legs.

14. A chair in accordance with claim 13, further comprising:

a) inner and outer overlapping bores formed between the inner and outer clamps and oriented transverse to one another; and b) the front and rear legs disposed in different ones of the inner and outer overlapping bores.

15. A chair in accordance with claim 14, wherein the inner and outer bores are formed by channels in the inner and outer clamps; and further comprising ribs extending into the channels causing an interference fit between the ribs and the front and rear legs.

16. A chair in accordance with claim 13, wherein the inner and outer clamps further comprise:

a plurality of intermeshing posts, fingers or both, on both of the inner and outer clamps with the posts, fingers or both of the inner clamp intermeshing with the posts, fingers or both of the outer clamp.

17. A chair in accordance with claim 13, wherein the joint is formed by the inner and outer clamps and the front and rear legs; and wherein the joint is substantially solid with substantially no exposed openings.

18. A chair in accordance with claim 13, wherein the front and rear legs are disposed adjacent one another at the overlap without any intermediate structure between the front and rear legs at the overlap.

19. A chair in accordance with claim 13, wherein both the inner and outer clamps further comprise:

a channel disposed between posts; and wherein the joint further comprises:

an inner bore formed between an inner channel in the inner clamp and posts of the outer clamp; and an outer bore formed between an outer channel in the outer clamp and posts of the inner clamp; and the inner and outer bores oriented transverse to one another and the inner and outer channels oriented transverse to one another and the posts of the outer clamp being offset with respect to the posts of the inner clamp.

20. A chair in accordance with claim 13, further comprising:

a bolt extending through the outer clamp, the front and rear legs, and the inner clamp at the joint.

21. A chair in accordance with claim 13, wherein the inner clamp is integrally formed with the seat as a single integral, monolithic member of continuous material.

22. A chair in accordance with claim 13, wherein the front and rear legs are clamped independently of one another between the inner and outer clamps so that the front and rear legs have a non-contacting relationship at the joint and between the inner and outer clamps.

23. A chair in accordance with claim 13, wherein the joint further comprises:

a tab extending from the joint to engage a leg or a frame of a lower stacked chair.

24. A chair in accordance with claim 13, wherein the joint further comprises:

a dimple formed in the joint to receive a leg of an upper stacked chair.

25. A chair in accordance with claim 1, further comprising:

a) the front and rear legs overlapping each other at overlaps on each side of the seat with one of the front and rear legs outside of another of the front and rear legs with respect to the seat;

b) joints on each side of the seat coupling the legs to the seat including inner clamps coupled to opposite sides of the seat and outer clamps coupled to the inner clamps on opposite sides of the seat with the legs clamped between the inner and outer clamps at the overlaps; and c) a notch disposed on one of the outer clamps on one side of the seat;

d) a tab disposed on another of the outer clamps on another side of the seat; and e) the notch capable of receiving a tab of an adjacent chair to gang the chairs together at adjacent joints.

26. A chair in accordance with claim 25, further comprising:

a pair of different caps each disposed on a different one of the outer clamps, including a notch cap with the notch formed therein and a tab cap with the tab formed therein.

27. A chair in accordance with claim 1, further comprising:

armrests disposed on extensions of the rear legs, each armrest including a brace with a shaft inserted into an open tubular end of the extension of the rear leg and an arm extending therefrom, and a cover disposed over the arm.

28. A stackable chair, comprising:

a) a seat and a backrest carried between opposite frame sides each with a backrest support, a front leg and a rear leg, the front and rear legs fixed in a spaced apart relationship from one another, the front and rear legs being inclined outwardly to facilitate stacking with another chair;

b) the seat having a continuous sheet of flexible and elastic mesh held taut across and substantially covering an opening in an all-plastic seat hoop, the seat hoop coupled between the frame sides;

c) the seat hoop having a rigid plastic seat-support bar laterally traversing the hoop of the seat and having an arcuate shape into which the sheet of mesh of the seat is deflectable;

d) the backrest having a continuous sheet of flexible and elastic mesh held taut across and substantially covering an opening in an all-plastic backrest hoop, the backrest hoop fixed between the backrest supports of the frame sides;

e) the all-plastic hoop of the backrest and the all-plastic hoop of the seat form the sole structural support between the frame sides;

f) one of the front or rear legs being outside of another of the front or rear legs with respect to the seat and with one of the front or rear legs overlapping another of the front or rear legs at an overlap;

g) a joint coupling the legs to the seat including an inner clamp coupled to the seat and an outer clamp coupled to the inner clamp with the front leg and the rear leg clamped between the inner and outer clamps at the overlap;

h) wherein the front and rear legs are disposed adjacent one another at the overlap without any intermediate structure between the front and rear legs at the overlap; and i) wherein the inner and outer clamps further comprise: a plurality of intermeshing posts, fingers or both, on both of the inner and outer clamps with the posts, fingers or both of the inner clamp intermeshing with the posts, fingers or both of the outer clamp.

29. A device in accordance with claim 13, wherein the finger extends laterally across an entire width of the front and rear legs.

30. A stackable chair, comprising:

a) a seat and a backrest carried between opposite frame sides each with a backrest support, a front leg and a rear leg, the front and rear legs fixed in a spaced apart relationship from one another, the front and rear legs being inclined outwardly to facilitate stacking with another chair;

b) one or both of the seat and the backrest having a continuous sheet of flexible and elastic mesh or patterned open texture plastic held across and substantially covering an opening in an all-plastic hoop fixed between the frame sides;

c) one of the front or rear legs being outside of another of the front or rear legs with respect to the seat and with one of the front or rear legs overlapping another of the front or rear legs at an overlap;

d) a joint coupling the legs to the seat including an inner clamp coupled to the seat and an outer clamp coupled to the inner clamp with the front leg and the rear leg clamped between the inner and outer clamps at the overlap;

e) wherein the front and rear legs are disposed adjacent one another at the overlap without any intermediate structure between the front and rear legs at the overlap; and f) wherein the inner and outer clamps further comprise: a plurality of intermeshing posts, fingers or both, on both of the inner and outer clamps with the posts, fingers or both of the inner clamp intermeshing with the posts, fingers or both of the outer clamp.

* * * * *